US010448141B2

(12) United States Patent
Na et al.

(10) Patent No.: US 10,448,141 B2
(45) Date of Patent: Oct. 15, 2019

(54) EARPHONE

(71) Applicant: LG ELECTRONICS INC., Seoul (KR)

(72) Inventors: Yonghyuk Na, Seoul (KR); Jungyoun Kang, Seoul (KR); Jaeyoung Lee, Seoul (KR); Taehoon Yoo, Seoul (KR); Shin Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/854,056

(22) Filed: Dec. 26, 2017

(65) Prior Publication Data

US 2018/0184192 A1 Jun. 28, 2018

(30) Foreign Application Priority Data

Dec. 26, 2016 (KR) ..... 10-2016-0179178
Apr. 26, 2017 (KR) ..... 10-2017-0053824

(51) Int. Cl.
*H04R 1/10* (2006.01)
*H04R 1/12* (2006.01)
(Continued)

(52) U.S. Cl.
CPC ..... *H04R 1/1058* (2013.01); *H04R 1/1016* (2013.01); *H04R 1/1033* (2013.01);
(Continued)

(58) Field of Classification Search
CPC ..... H04R 1/1058; H04R 31/006; H04R 1/24; H04R 1/1091; H04R 1/1033; H04R 1/1016; H04R 1/2803; H04R 1/12
See application file for complete search history.

(56) References Cited

U.S. PATENT DOCUMENTS 4,972,488 A * 11/1990 Weiss ..... H04R 25/654 381/322
8,265,327 B2 * 9/2012 Ishizaka ..... H04R 1/12 381/324

(Continued)

FOREIGN PATENT DOCUMENTS

CN 205213013 U 5/2016
CN 106165442 A 11/2016

(Continued)

*Primary Examiner* — Oyesola C Ojo
(74) *Attorney, Agent, or Firm* — Birch, Stewart, Kolasch & Birch, LLP

(57) ABSTRACT

An earphone capable of making it easy to remove foreign substances that have accumulated on a nozzle portion and easy to control sound characteristics thereof is provided. The earphone includes a driver, a housing defining an electrical component mount on which the driver is mounted, a nozzle portion provided at one end of the housing and defining therein a nozzle hole communicating with the electrical component mount, a nozzle cap detachably coupled to an outer circumferential surface of the nozzle portion, and a nozzle mesh provided at the nozzle cap so as to cover the nozzle hole, wherein the nozzle cap serves to decrease output in a second peak region in a graph of output over frequency for the earphone and to increase a fourth peak region or expand a bandwidth of the fourth peak region in the graph.

18 Claims, 24 Drawing Sheets

(51) Int. Cl.
*H04R 1/28* (2006.01)
*H04R 1/24* (2006.01)
*H04R 31/00* (2006.01)

(52) U.S. Cl.
CPC ..... *H04R 1/1091* (2013.01); *H04R 1/12* (2013.01); *H04R 1/24* (2013.01); *H04R 1/2803* (2013.01); *H04R 31/006* (2013.01)

(56) References Cited

U.S. PATENT DOCUMENTS

| | | | | |
|---|---|---|---|---|
| 8,767,995 | B2 * | 7/2014 | Hwang | H04R 1/1091 381/370 |
| 8,831,266 | B1 * | 9/2014 | Huang | H04R 1/1091 381/380 |
| 9,055,364 | B1 | 6/2015 | Uh et al. | |
| 2003/0081794 | A1 * | 5/2003 | Fushimi | H04R 1/1016 381/74 |
| 2007/0189569 | A1 * | 8/2007 | Haapapuro | H04R 1/1016 381/380 |
| 2008/0013773 | A1 | 1/2008 | Yang | |
| 2008/0240486 | A1 | 10/2008 | Garcia et al. | |
| 2009/0103764 | A1 | 4/2009 | Stiehl et al. | |
| 2010/0331058 | A1 * | 12/2010 | Qingshan | H04M 1/035 455/575.1 |
| 2011/0031060 | A1 | 2/2011 | Epping et al. | |
| 2011/0051981 | A1 * | 3/2011 | Lehdorfer | H04R 1/1075 381/380 |
| 2012/0020501 | A1 * | 1/2012 | Lee | H04R 1/1091 381/151 |
| 2012/0051574 | A1 * | 3/2012 | Lin | H04R 1/2803 381/353 |
| 2012/0093332 | A1 | 4/2012 | Lin et al. | |
| 2012/0321103 | A1 * | 12/2012 | Smailagic | H04R 1/1041 381/98 |
| 2013/0163804 | A1 | 6/2013 | Hwang | |
| 2013/0188801 | A1 | 7/2013 | Ambrose et al. | |
| 2013/0259287 | A1 * | 10/2013 | Tseng | H04R 1/1016 381/380 |
| 2014/0119555 | A1 | 5/2014 | Lu | |
| 2015/0128431 | A1 | 5/2015 | Kuo | |
| 2015/0256921 | A1 * | 9/2015 | Martin | H04R 1/1016 381/380 |
| 2015/0264474 | A1 | 9/2015 | Seo et al. | |
| 2015/0382095 | A1 | 12/2015 | Shin et al. | |
| 2016/0066081 | A1 | 3/2016 | Annunziato et al. | |
| 2016/0269839 | A1 * | 9/2016 | Meyer | H04R 25/654 |
| 2016/0337747 | A1 | 11/2016 | Litovsky et al. | |

FOREIGN PATENT DOCUMENTS

| | | | |
|---|---|---|---|
| EP | 2306755 | A1 | 4/2011 |
| EP | 2480007 | A1 | 7/2012 |
| EP | 2822293 | A2 | 1/2015 |
| JP | 4966201 | B2 | 7/2012 |
| KR | 10-0962169 | B1 | 6/2010 |
| KR | 10-2010-0108871 | A | 10/2010 |
| KR | 10-2011-0125346 | A | 11/2011 |
| KR | 10-1479964 | B1 | 1/2015 |
| KR | 10-1673414 | B1 | 11/2016 |
| KR | 10-2016-0147687 | A | 12/2016 |
| WO | WO 2009/104833 | A1 | 8/2009 |

* cited by examiner

EARPHONE

CROSS-REFERENCE TO RELATED APPLICATIONS

This application claims the benefit of Korean Patent Application No. 10-2016-0179178, filed on Dec. 26, 2016 and Korean Patent Application No. 10-2017-0053824, filed on Apr. 26, 2017, the entire contents of each of which is hereby incorporated by reference as if fully set forth herein.

BACKGROUND OF THE INVENTION

Field of the Invention

The present invention relates to an earphone, and, more particularly, to an earphone including a nozzle cap, which covers a nozzle portion and is able to be detachably coupled to the earphone.

Discussion of the Related Art

An earphone includes a nozzle portion having a sound hole formed in an end thereof. The sound hole in the nozzle portion communicates with an electric component mount, on which a driver is mounted, thereby serving as an outlet from which sound is output.

Generally, the sound hole in the nozzle portion is covered by a mesh. The mesh serves to prevent foreign substances from entering the earphone and to control the sound pressure acting on the earphone so as to affect the sound characteristics. When the mesh is integrally coupled to the nozzle portion, it is difficult to remove foreign substances that have accumulated on the nozzle portion and there is a possibility of generation of unintended noise during sound output.

Accordingly, in light of these problems, the structure surrounding the sound hole in the nozzle portion including the mesh may be configured to be replaceable. When the mesh is configured to be replaceable, it is possible to not only remove foreign substances but also to replace the mesh with another mesh having a different shape or structure. Therefore, it is also possible to change the sound characteristics by controlling the sound pressure with different meshes.

Accordingly, the present invention proposes an earphone which includes a replaceable mesh in consideration of the above problems.

Specifically, the sound quality, tone color and the like of sound output through a receiver are roughly determined based on the sound source information. Here, the sound quality, the tone color and the like may be finely changed due to physical properties of the receiver for outputting the sound source and due to the electronic distortion of a sound source signal caused by an audio tuner provided in the receiver or the like. The term "receiver" as used herein may refer to a device for outputting sound, such as an earphone.

In association with the physical properties of an earphone, the amount of air passing through a receiver may serve as a factor on the extent of output in a specific frequency range of the outputted sound. In other words, in a housing of an earphone which includes a driver mounted therein, the amount of air introduced into or discharged from the inside of the housing may have an influence on output in a specific sound range.

Particularly, in order to control output in a bass frequency range, it is possible to change the amount of air flowing through a hole in a housing behind a driver.

The distance between the rear surface of the driver and the hole in the housing may serve as a factor affecting the amount of air flowing through the hole behind the driver in the housing.

As an approach for controlling the amount of air, it is possible to change the position of the driver so as to change the distance between the driver and the hole in the housing. However, because there is a limit on the control of the shape and size of the housing, it is impossible to unlimitedly increase the distance between the hole in the housing and the driver.

Therefore, there is a necessity for an earphone structure capable of controlling an airflow amount by maximizing the distance between the hole in the housing and the driver in the limited inner space in the earphone housing.

Furthermore, there is also a necessity for an earphone structure capable of controlling output in a specific frequency range by controlling an airflow amount.

SUMMARY OF THE INVENTION

Accordingly, the present invention is directed to an earphone that substantially obviates one or more problems due to limitations and disadvantages of the related art.

Therefore, the present invention has been made in view of the above problems, and an object of the present invention is to provide an earphone capable of easily removing foreign substances that have accumulated on a nozzle portion and easily controlling sound characteristic.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an earphone includes a driver, a housing defining an electrical component mount on which the driver is mounted, a nozzle portion provided at one end of the housing and defining therein a nozzle hole communicating with the electrical component mount, a nozzle cap detachably coupled to an outer circumferential surface of the nozzle portion, and a nozzle mesh provided at the nozzle cap so as to cover the nozzle hole, wherein the nozzle cap serves to decrease output in a second peak region in a graph of output over frequency of the earphone and to increase a fourth peak region or expand a bandwidth of the fourth peak region in the graph.

According to the present invention, the peak regions may reside in a frequency range of 2 kHz-20 kHz.

In another aspect of the present invention, an earphone includes a driver, a housing defining an electrical component mount on which the driver is mounted, a nozzle portion provided at one end of the housing and defining therein a nozzle hole communicating with the electrical component mount, a nozzle cap detachably coupled to an outer circumferential surface of the nozzle portion, and a nozzle mesh provided at the nozzle cap so as to cover the nozzle hole, wherein the nozzle cap includes a first nozzle cap, a second nozzle cap and a third nozzle cap, all of which are interchangeable with one another.

According to the present invention, the sound characteristics of bass may be output upon coupling of the first nozzle cap to the nozzle portion, the sound characteristics of midrange may be output upon coupling of the second nozzle cap to the nozzle portion, and the sound characteristics of treble may be output upon coupling of the third nozzle cap to the nozzle portion.

According to the present invention, in a graph of output over frequency of the earphone, assuming that an output value corresponding to 1 kHz is designated as R, an area of an output value between 100 Hz to 1 kHz is designated as A and an area of an output value between 1 kHz to 10 kHz is designated as B, a value of B/(A+B) may be less than 0.35 upon coupling of the first nozzle cap to the nozzle portion, the value of B/(A+B) may range from 0.35 to 0.65 upon coupling of the second nozzle cap to the nozzle portion, and the value of B/(A+B) may exceed 0.65 upon coupling of the third nozzle cap to the nozzle portion.

According to the present invention, in a frequency range of 2 kHz to 6 kHz, there may be a frequency range in which output upon coupling of the first nozzle cap is increased by 3 dB or more than output upon coupling of the second nozzle cap and a frequency range in which output upon coupling of the third nozzle cap is decreased by 3 dB or more than the output upon coupling of the second nozzle cap.

In a further aspect of the present invention, an earphone includes a driver, a housing defining an electrical component mount on which the driver is mounted, a nozzle portion provided at one end of the housing and defining therein a nozzle hole communicating with the electrical component mount, a nozzle cap detachably coupled to an outer circumferential surface of the nozzle portion, a nozzle mesh provided at the nozzle cap so as to cover the nozzle hole, and a hook unit provided on an outer circumferential surface of the nozzle portion and an inner circumferential surface of the nozzle cap.

According to the present invention, the hook unit may include a protruding portion provided on one of the outer circumferential surface of the nozzle portion and the inner circumferential surface of the nozzle cap, and a depressed portion provided in a remaining one of the outer circumferential surface of the nozzle portion and the inner circumferential surface of the nozzle cap so as to correspond to the protruding portion.

According to the present invention, the nozzle cap may have an outer diameter, which is larger by a predetermined value than an outer diameter of a first region of the nozzle portion adjacent to the nozzle cap.

According to the present invention, the nozzle cap may have an outer diameter, which is equal to an outer diameter of a second region of the nozzle portion spaced apart from the nozzle cap, and the earphone may further include an ear tip, which is coupled so as to surround the nozzle cap and the second region of the nozzle portion.

According to the present invention, the nozzle cap may include an ABS material, and may be integrally formed with the nozzle mesh through insert injection molding.

According to the present invention, the nozzle cap may include an opening through which the nozzle mesh is exposed to the outside and which has a diameter equal to the inner diameter of the nozzle portion.

According to the present invention, the earphone may further include an ear tip, which is coupled so as to surround the nozzle cap and the nozzle and which surrounds a portion of an upper surface of the nozzle cap.

According to the present invention, the nozzle cap and the ear tip may include respective openings through which the nozzle mesh is exposed to outside, the opening in the nozzle cap having a diameter equal to the diameter of the opening in the ear tip.

In a further aspect of the present invention, an earphone includes a driver, a housing defining an electrical component mount on which the driver is mounted, a nozzle portion provided at one end of the housing and defining therein a nozzle hole communicating with the electrical component mount, a nozzle cap detachably coupled to an outer circumferential surface of the nozzle portion, a nozzle mesh provided at the nozzle cap so as to cover the nozzle hole, and a bent portion extending from the nozzle cap and bent toward an inner circumferential surface of the nozzle portion, wherein the bent portion is engaged with a depressed portion formed in the outer circumferential surface of the nozzle portion.

According to the present invention, the nozzle cap may include a SUS material.

In another further aspect of the present invention, an earphone includes a driver, a housing defining an electrical component mount on which the driver is mounted, a nozzle portion provided at one end of the housing and defining therein a nozzle hole communicating with the electrical component mount, a nozzle cap detachably coupled to an outer circumferential surface of the nozzle portion, and a nozzle mesh provided at the nozzle cap so as to cover the nozzle hole, wherein the nozzle cap is coupled to the nozzle portion in a screw engagement manner.

In still a further aspect of the present invention, an earphone includes a driver, a housing defining an electrical component mount on which the driver is mounted, a nozzle portion provided at one end of the housing and defining therein a nozzle hole communicating with the electrical component mount, a nozzle cap detachably coupled to an outer circumferential surface of the nozzle portion, and a nozzle mesh provided at the nozzle cap so as to cover the nozzle hole, wherein the nozzle mesh includes a first nozzle mesh and a second nozzle mesh overlapping the first nozzle mesh.

According to the present invention, the second nozzle mesh may be stacked on the first nozzle mesh, and the first nozzle mesh may be provided in a portion of a first region defined by the second nozzle mesh.

According to the present invention, the earphone may further include a subsidiary nozzle mesh provided in the nozzle hole in the nozzle portion, and the nozzle cap may be rotatably coupled to the outer circumferential surface of the nozzle portion so as to change an airflow amount by overlapping between the nozzle mesh and the subsidiary nozzle mesh due to rotation of the nozzle cap.

According to the present invention, the subsidiary nozzle mesh may define a plurality of parallel linear holes, and the nozzle mesh may define a plurality of parallel linear holes, the plurality of parallel linear holes in the nozzle mesh being aligned with the plurality of parallel linear holes in the subsidiary nozzle mesh when the nozzle cap is rotated to a first angle and being oriented to be perpendicular to the plurality of parallel linear holes in the subsidiary nozzle mesh when the nozzle cap is rotated to a second angle.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Description will now be given in detail according to exemplary embodiments disclosed herein, with reference to the accompanying drawings. For the sake of brevity of description with reference to the drawings, the same or equivalent components may be denoted by the same reference numbers, and description thereof will not be repeated. In general, suffixes such as "module" and "unit", which are used in the following description, may be used to refer to elements or components for easy preparation of the specification. The use of such suffixes herein is merely intended to facilitate description of the specification, and the suffixes do not have any special meaning or function. Furthermore, in the following description of embodiments disclosed herein, if it is decided that the detailed description of known functions or configurations related to the invention makes the subject matter of the invention unclear, such detailed description is omitted. The accompanying drawings are used to assist in easy understanding of various technical features and it should be understood that the embodiments presented herein are not to be limited by the accompanying drawings. As such, the present disclosure should be understood in an expand manner that encompasses any alterations, equivalents and substitutes in addition to those which are particularly set out in the accompanying drawings.

Figure 1:
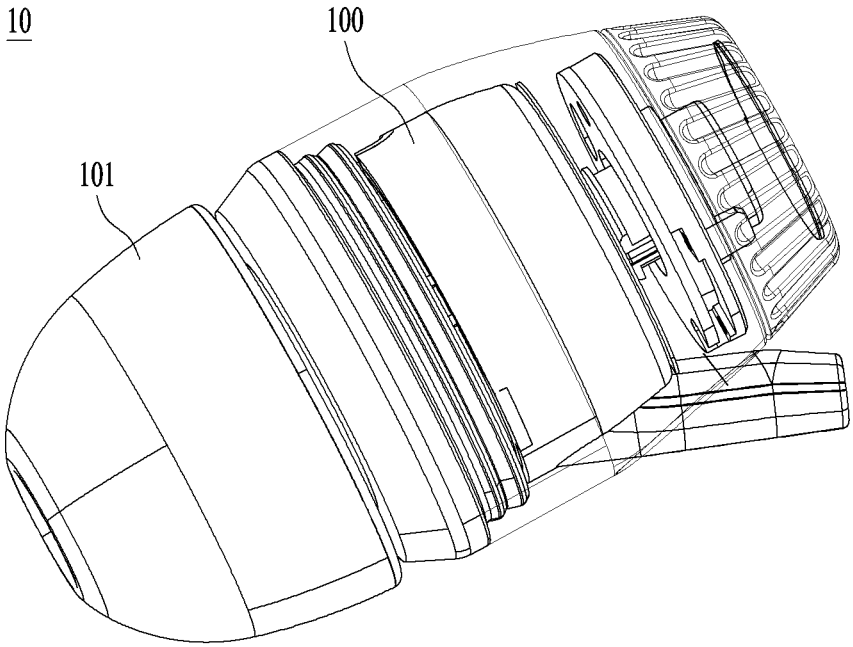
FIG. 1 is a perspective view of an earphone according to the present invention.
Figure 2:
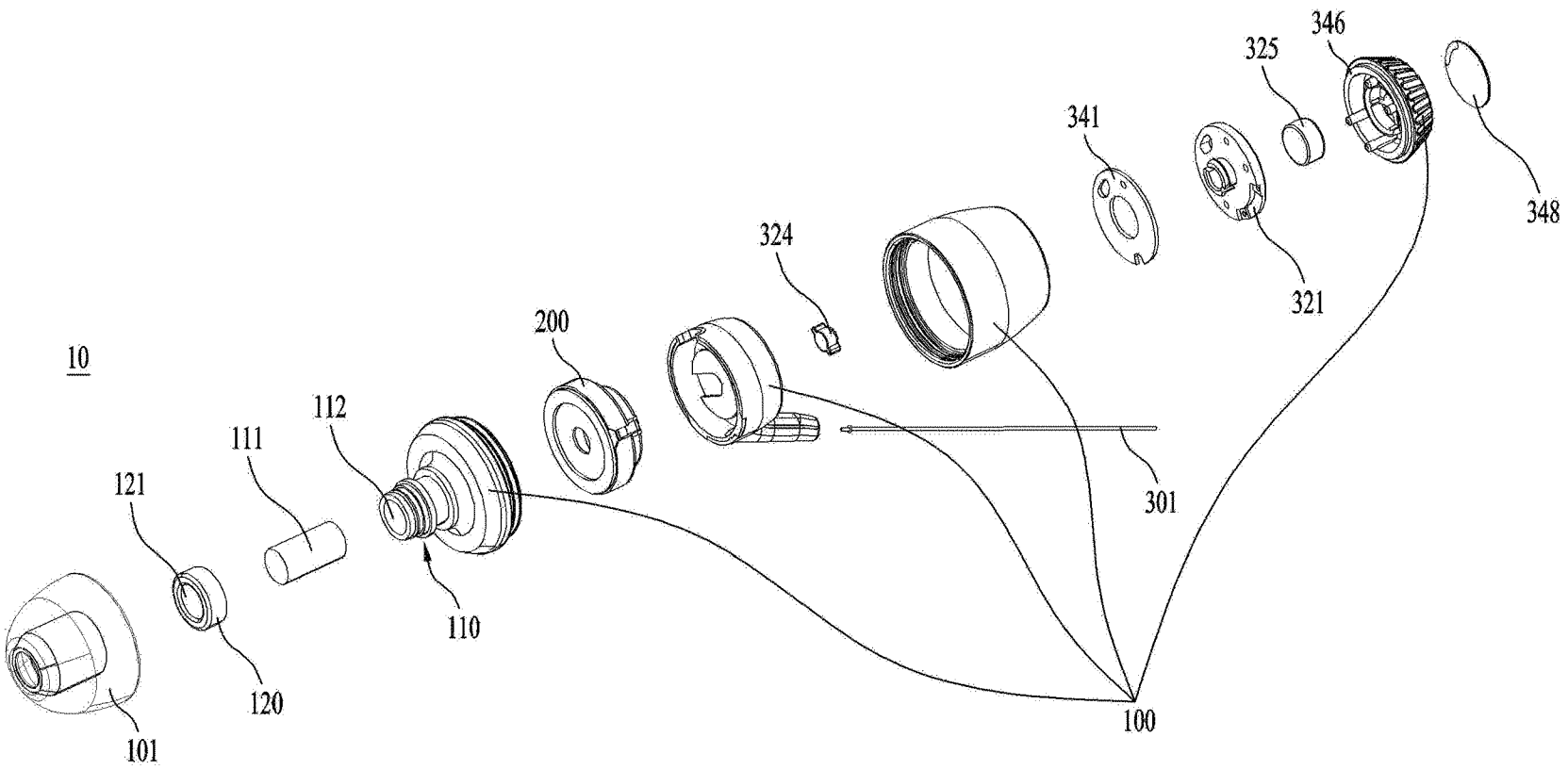
FIG. 2 is an exploded perspective view of the earphone according to the present invention.

FIG. 1 is a perspective view of an earphone 10 according to the present invention. FIG. 2 is an exploded perspective view of the earphone 10 according to the present invention. For the convenience of explanation, the present invention will now be described with reference to both FIG. 1 and FIG. 2.

The earphone 10 may include, as main components, a driver 200 and a housing 100 in which the driver 200 is mounted. The driver 200 receives a sound source signal and vibrates a vibration plate in response to the signal, thereby generating sound. The driver 200 may include a coil and a magnet in addition the vibration plate. The housing 100 defines the appearance of the earphone 10 and defines an electrical component mount in which the driver 200 is mounted. The electrical component mount defined by the housing 100 may also be provided with a main circuit board on which an electrical component for driving the driver 200 is mounted.

An ear tip 101 may be coupled to one end of the housing 100 so as to assist insertion of the earphone 10 into a user's ear and to minimize the introduction of external noise into the user's ear.

An ear unit wire 301 may be connected to the earphone 10 so as to receive and transmit a signal from and to a main body.

A magnet 325 may be provided in the earphone 10 so as to detachably couple to the main body.

A nozzle portion 110 may be provided at one end of the housing 100. The nozzle portion 110 defines a sound hole through which sound created by the driver 200 is output. An opening formed in an end of the nozzle portion 110 communicates with the electrical component mount through the sound hole 112 in the nozzle portion 110.

A nozzle cap 120 including a nozzle mesh 121 may be provided at the opening and the sound hole 112 in the nozzle portion 110. The nozzle mesh 121 and the nozzle cap 120 control the amount of air flowing through the earphone 10, that is, a sound pressure, thereby affecting the acoustic characteristic of the earphone 10. A detailed description thereof will be given later.

The nozzle mesh 121 refers to a concrete form in which the above-described mesh is applied to the present invention. The nozzle mesh 121 covers the opening in the nozzle portion 110 in order to prevent the introduction of external foreign substances into the electrical component mount of the housing 100 in addition to providing an effect on the sound pressure and acoustic characteristics of the earphone 10.

The nozzle mesh 121 may be detachably coupled to the nozzle portion 110 of the housing 100 through the nozzle cap 120 in a removable or replaceable manner.

The nozzle cap 120 may be detachably coupled to the nozzle portion 110 in the state of being coupled to the nozzle mesh 121. The nozzle mesh 121 and a cover mesh, which overlap each other, may be provided at the nozzle cap 120 when necessary. The cover mesh serves to prevent external foreign substances from being introduced into the sound hole 112 in the nozzle portion 110 and to improve durability by realizing a predetermined rigidity. The cover mesh may have holes larger than those in the nozzle mesh 121 so as not to affect the acoustic characteristics of the earphone 10. Accordingly, it is assumed that the acoustic characteristics, which are to be described later, are not affected by the cover mesh.

A nozzle filter 111 may be provided in the sound hole 112 in the nozzle portion 110. The nozzle filter 111 serves to smoothly control the gradient of a frequency range of 1 kHz-3 kHz. The nozzle filter 111 may be made of a urethane foam material.

Hereinafter, the principle by which the sound characteristics of the earphone 10 are affected by the amount of air flowing through the earphone 10 and by the sound pressure will be briefly described.

Figure 3:
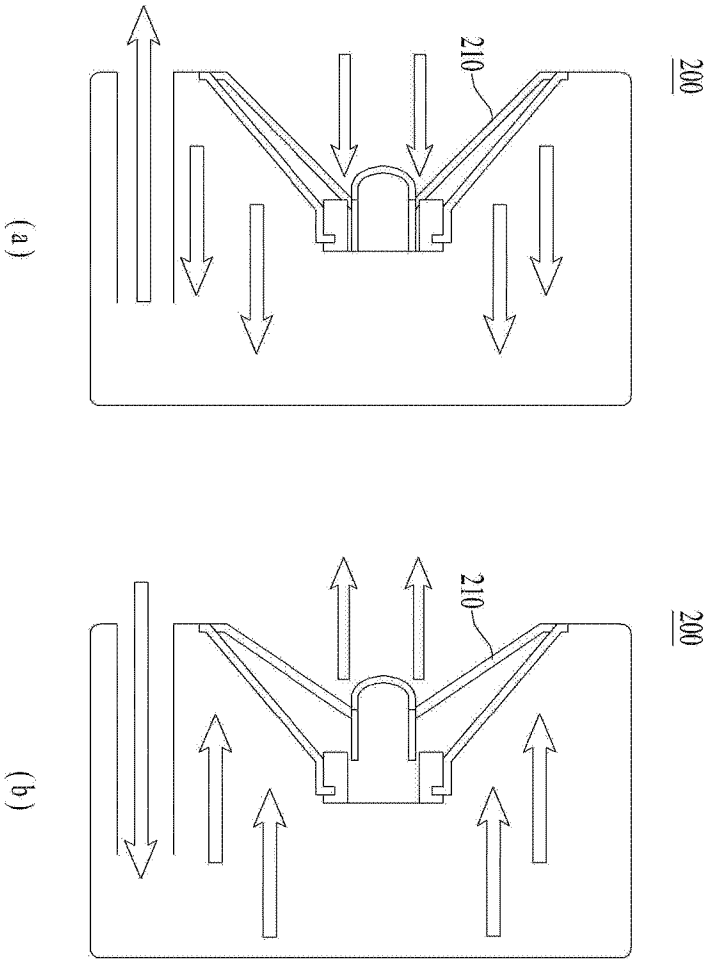
FIG. 3 is a schematic cross-sectional view of a driver of the earphone according to the present invention.

FIG. 3 is a schematic cross-sectional view of the driver 200 of the earphone 10 according to the present invention.

In association with the physical characteristics of the earphone 10, the amount of air flowing through the earphone 10 may be a factor affecting output intensity in a specific frequency range of sound output from the earphone. In other words, in the housing 100 in which the driver 200 is mounted, the amount of air that is introduced into and discharged from the housing 100 may affect the output intensity in a specific frequency range of sound.

When the vibration plate 210 of the driver 200 is compressed as shown in FIG. 3(*a*), the inside of the driver 200 is compressed and the interior air is thus discharged to the outside. When the vibration plate 210 of the driver 200 is expanded as shown in FIG. 3(*b*), the inside of the driver 200 is expanded and exterior air is introduced into the driver 200.

The repeated compression and expansion of the vibration plate 210, as shown in FIGS. 3(*a*) and 3(*b*), causes generation of sound. As the vibration displacement of the vibration plate 210 is increased, sound output in a specific frequency range is increased. As the vibration displacement of the vibration plate 210 is decreased, sound output in a specific frequency range is decreased. The vibration displacement of the vibration plate 210 may be controlled by the amount of air that can be introduced into and discharged from the driver 200.

When the amount of air that can be introduced into and discharged from the driver 200, that is, the airflow amount is increased, the pressure acting on the driver 200 is relatively low and the vibration displacement of the vibration plate 210 is thus increased, thereby increasing the sound output in a specific frequency range. In contrast, when the airflow amount is decreased, the pressure acting on the driver 200 is relatively high and the vibration displacement of the vibration plate 210 is thus decreased, thereby decreasing the sound output in a specific frequency range.

Figure 4:
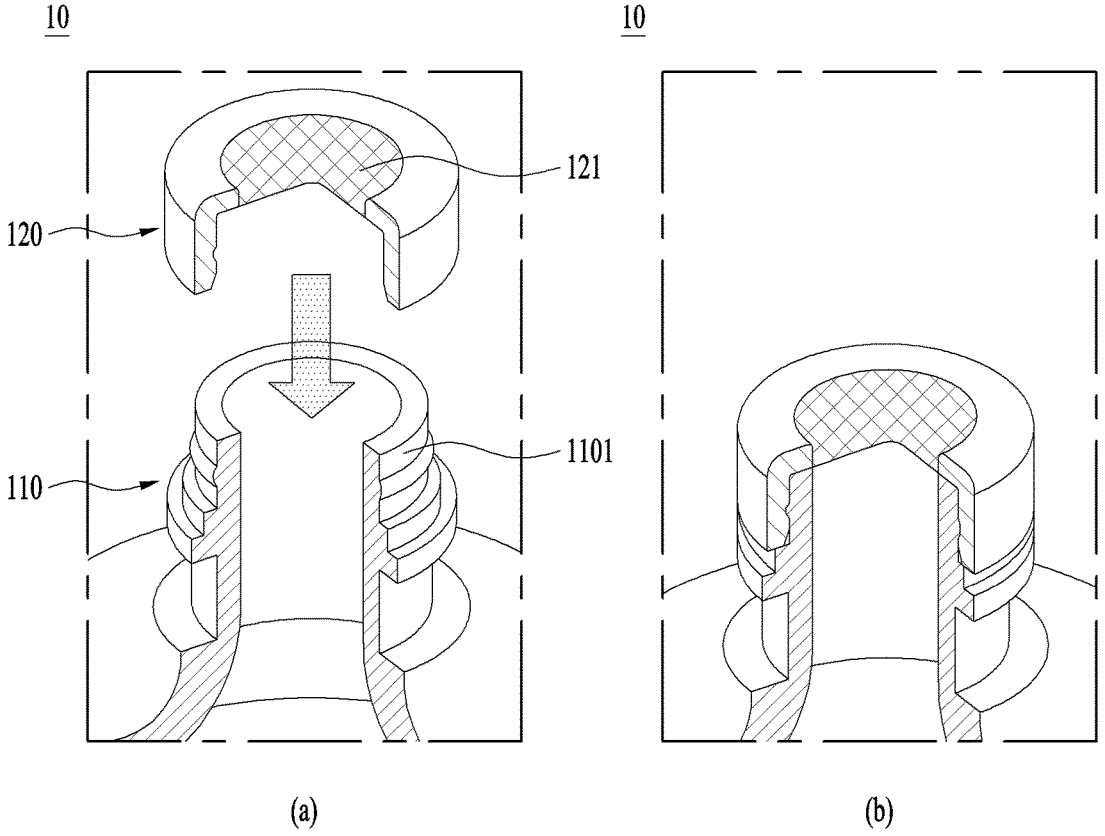
FIG. 4 is a perspective view illustrating the earphone according to the present invention before and after a nozzle cap is coupled thereto.

FIG. 4 is a perspective view illustrating the earphone 10 according to the present invention before and after the nozzle cap 120 is coupled to the earphone 10.

The shapes of the sound hole in the nozzle portion 110, the nozzle mesh 121 and the nozzle cap 120 affect the sound characteristics of the earphone 10. Accordingly, the length and the diameter of the nozzle portion 110 also affect the sound characteristics, and design based on the feature is a critical variable in the control of sound characteristics.

In consideration of the feature, the nozzle cap 120 according to the present invention may be detachably coupled to the outer circumferential surface of the nozzle portion 110. If the nozzle cap 120 is coupled to the inner circumferential surface of the nozzle portion 110, airflow may be interrupted or air may leak due to manufacturing tolerance and coupling tolerance between the nozzle cap 120 and the nozzle portion 110, thereby generating noise in the sound output.

Accordingly, the coupling between the nozzle cap 120 and the outer circumferential surface 1101 of the nozzle portion 110 may minimize the unintended generation of noise.

The nozzle cap 120 may be coupled to the nozzle portion 110 in a hook engagement manner or in a screw engagement manner. A detailed description of each will follow.

Figure 5:
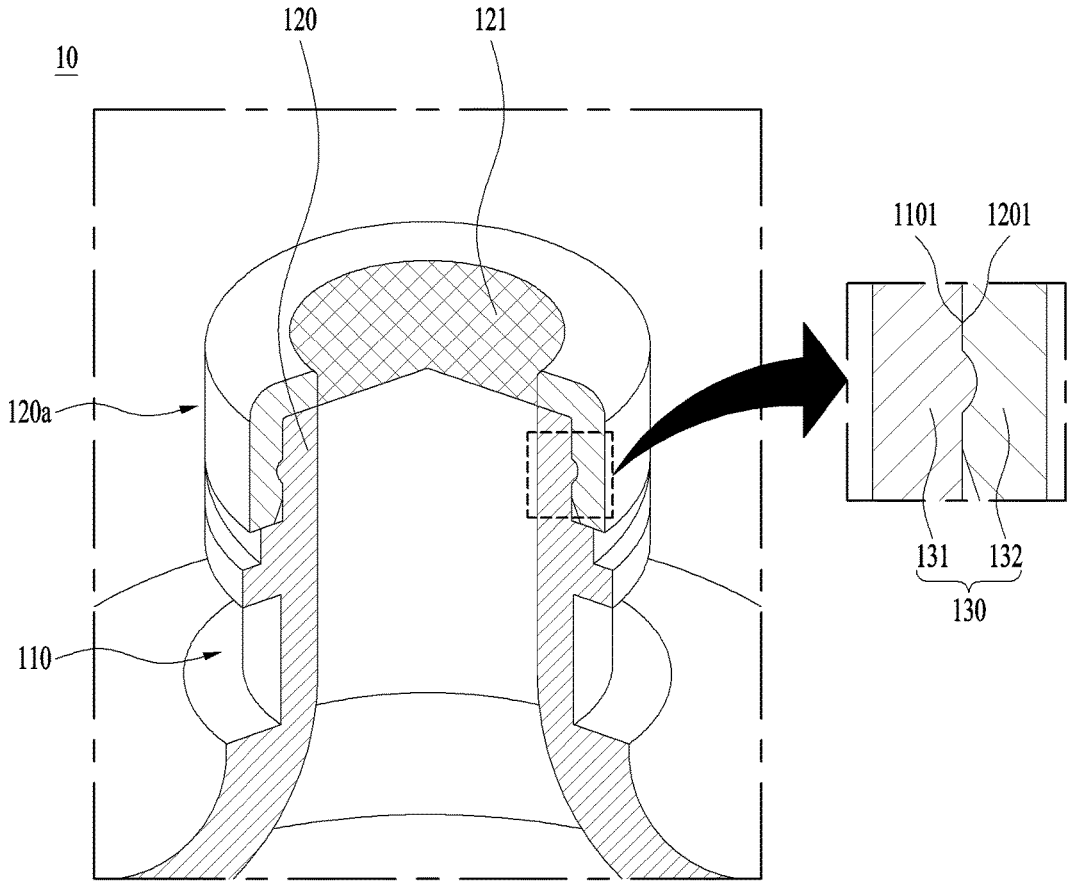
FIG. 5 is a perspective view of the earphone according to the present invention, shown in a partial breakaway view.

FIG. 5 is a perspective view of the earphone 10 according to an embodiment of the present invention, shown in a partial breakaway view.

Hereinafter, an embodiment in which the nozzle cap 120*a* is coupled to the nozzle portion 110 in a hook engagement manner will be described. The hook-type coupling may be realized by providing a hook unit 130 between the outer circumferential surface of the nozzle portion 110 and the inner circumferential surface of the nozzle cap 120. The hook unit 130 may include a protruding portion 131 and a depressed portion 132.

The protruding portion 131 may be formed along one of the outer circumferential surface of the nozzle portion 110 and the inner circumferential surface of the nozzle cap 120, and the depressed portion 132 may be formed along the other of the outer circumferential surface of the nozzle portion 110 and the inner circumferential surface of the nozzle cap 120. In an example, as shown in FIG. 5, the protruding portion 131 may be formed along the outer circumferential surface 1101 of the nozzle portion 110, and the depressed portion 132 may be formed along the inner circumferential surface 1201 of the nozzle cap 120. Alternatively, the protruding portion 131 may be formed along the inner circumferential surface of the nozzle cap 120, and the depressed portion 132 may be formed along the outer circumferential surface of the nozzle portion 110.

Although FIG. 5 illustrates a pair of elements, in this instance, the protruding portion 131 and the depressed portion 132, two or more pairs of elements may be provided in some cases.

The nozzle cap 120*a* may be coupled to the nozzle portion 110 so as to surround the upper portion of the outer circumferential surface of the nozzle portion 110 and the upper end surface of the nozzle portion 110.

Figure 6:
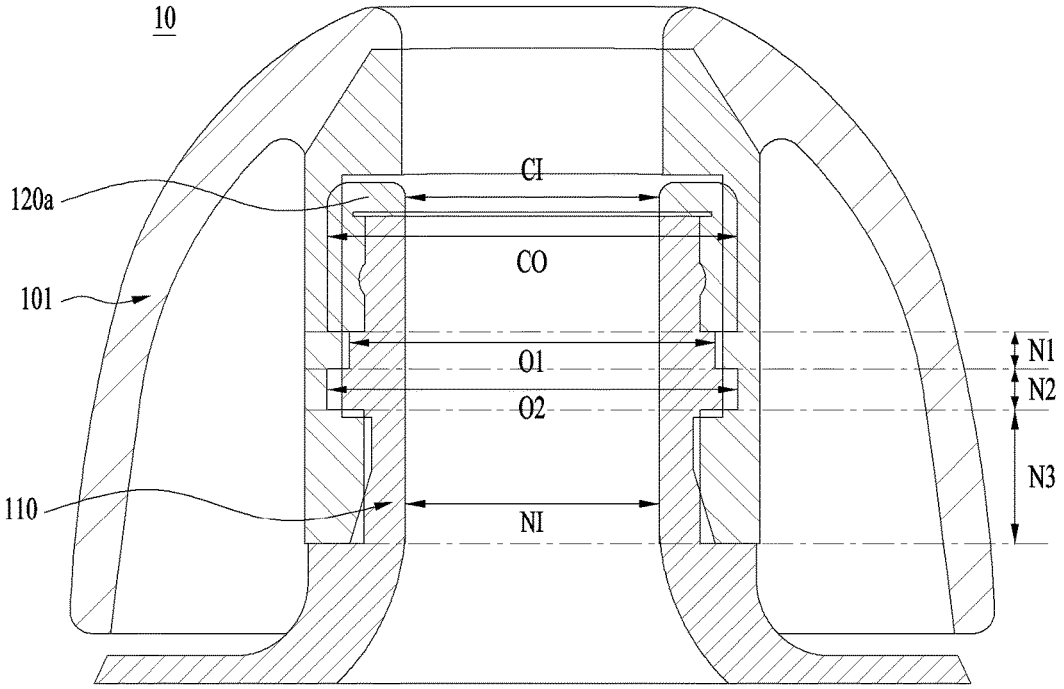
FIG. 6 is a cross-sectional view of the earphone shown in FIG. 5, in which an ear tip is coupled to the earphone.

FIG. 6 is a cross-sectional view illustrating a structure in which the ear tip 101 is coupled to the earphone 10 of FIG. 5.

The diameter CI of the opening in the nozzle cap 120 is preferably equal to or larger than the diameter NI of the opening in the nozzle portion 110. The reason for this is to prevent the generation of noise due to interference between sound waves output from the nozzle portion 110 and the nozzle cap 120.

The outer diameter CO of the nozzle cap 120 may be larger than the outer diameter O1 of a first region of the nozzle portion 110 adjacent to the nozzle cap 120 by a predetermined value. In other words, a stepped structure may be provided at the boundary region between the nozzle cap 120 and the nozzle portion 110 so as to allow the nozzle cap 120 to be easily removed by inserting a fingernail into the stepped structure.

The outer diameter CO of the nozzle cap 120 may be equal to the outer diameter O2 of a second region of the nozzle portion 110. Specifically, although the first region of the nozzle portion 110 is provided with the stepped structure so as to form a groove, the diameter of the second region is equal to the outer diameter of the nozzle cap 120 such that the ear tip 101 is engaged with the nozzle cap 120 and with the second region of the nozzle portion 110 as tightly as possible.

The ear tip 101 may be held in the state of surrounding the nozzle cap 120 and the second region of the nozzle portion 110. Since the ear tip 101 is configured to surround a portion of the upper surface of the nozzle cap 120, it is possible to prevent the nozzle cap 120 from being separated from the nozzle portion 110.

The ear tip 101 may be made of an elastic material having restoring force so as to prevent the ear tip 101 coupled to the nozzle portion 110 and the nozzle cap 120 from being easily separated therefrom. In other words, the ear tip 101 may be configured such that the inner diameter of the ear tip 101 in the state of not being subjected to an external force is smaller than the outer diameter of the nozzle cap 120 or the outer diameter of the second region of the nozzle portion 110, with the result that the ear tip 101 is stretched and then tightly coupled to the nozzle portion 110 and the nozzle cap 120.

Furthermore, since the lower end region of the inner circumferential surface of the ear tip 101 is engaged with a third region of the nozzle portion 110, it is possible to further increase the coupling force between the ear tip 101 and the nozzle portion 110.

Figure 7:
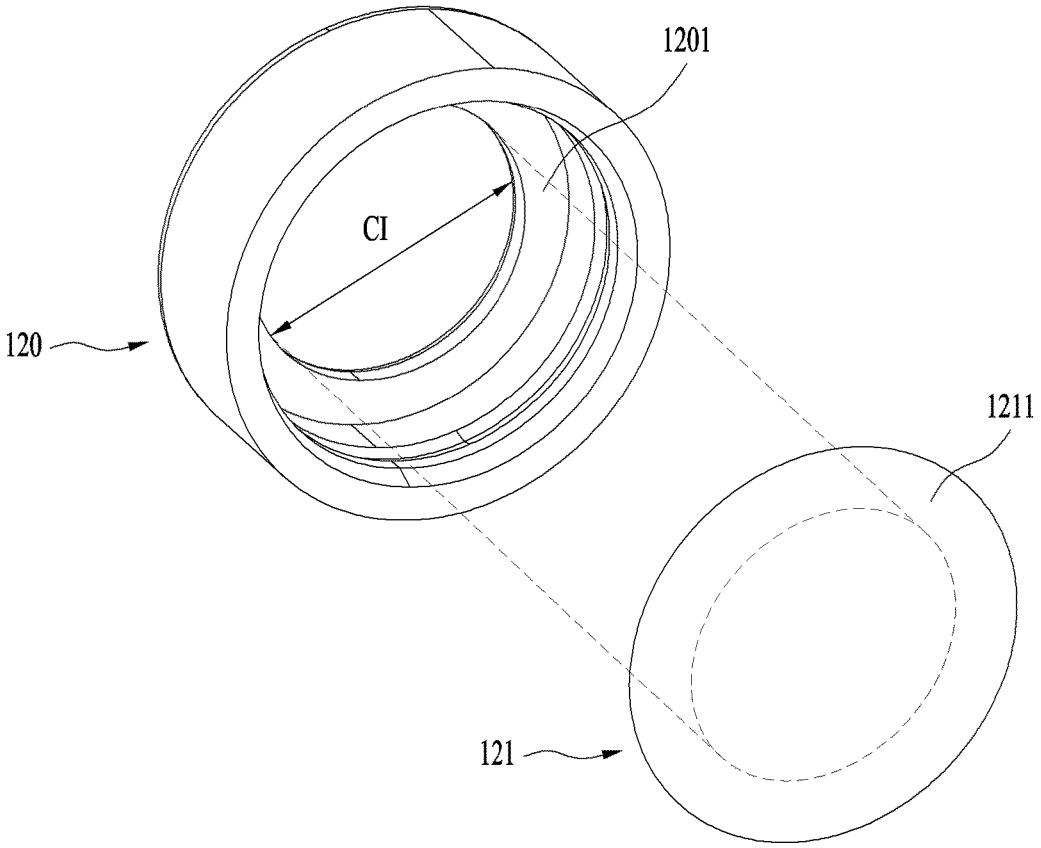
FIG. 7 is a rear perspective view of a nozzle cap and a nozzle mesh according to the present invention.

FIG. 7 is a rear perspective view of the nozzle cap 120 and the nozzle mesh 121 according to the present invention.

The nozzle mesh 121 may be provided inside the nozzle cap 120. The outer boundary region 1211 of the nozzle mesh 121 may overlap the inner surface region of the upper end of the nozzle cap 120 so as to define a coupling region.

Since the diameter of the nozzle mesh 121 is larger than the diameter of the opening in the nozzle cap 120, the nozzle mesh 121 is interposed and held between the nozzle portion 110 and the nozzle cap 120 when the nozzle mesh 121 is internally coupled to the nozzle cap 120. Consequently, it is possible to maintain the stable coupling of the nozzle mesh 121 and to prevent outward separation of the nozzle mesh 121.

The nozzle cap 120 and the nozzle mesh 121 may be coupled to each other by means of bonding, or by forming the nozzle cap 120 to the nozzle mesh 121 through insert injection molding. In the latter case, the nozzle cap 120 may be made of a material such as ABS resin.

Since the degree of freedom in the shape of the nozzle cap 120 is high, the protruding portion 131 may be formed on the center of the inner circumferential surface of the nozzle cap 120.

Figure 8:
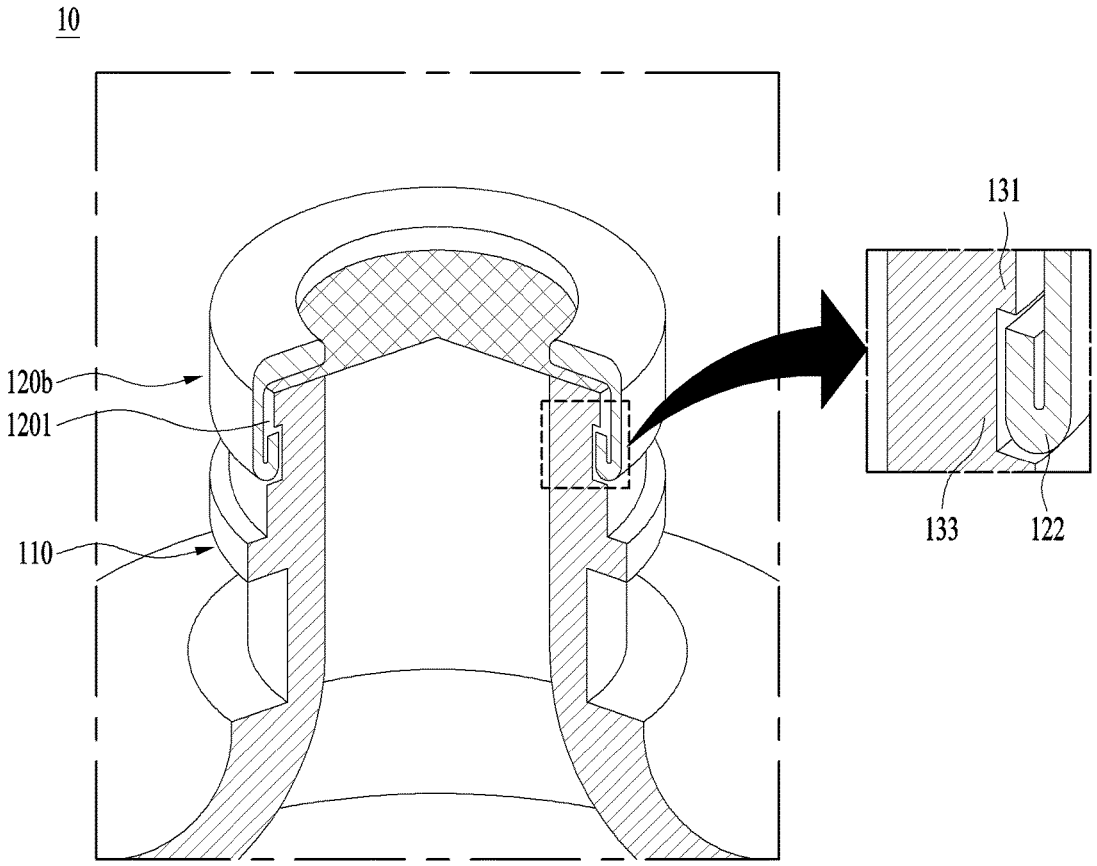
FIG. 8 is a perspective view of an earphone according to another embodiment of the present invention, shown in a partial breakaway view.

FIG. 8 is a perspective view of an earphone 10 according to another embodiment of the present invention, shown in a partial breakaway view.

The nozzle cap 120*b* may be made of a metal material. In the metal nozzle cap 120, a bent portion 122, which is formed by bending the concerned portion after injection through a metal mold, may serve as the hook.

The bent portion 122 may be formed at a portion of the inner circumferential surface of the nozzle cap 120*b*. Specifically, the bent portion 122 is formed by bending after injection through a metal mold, unlike the previous embodiment shown in FIGS. 5 to 7. Consequently, when the bent portion 122 is formed over the entire inner circumferential surface of the nozzle cap 120*b*, it is unlikely to provide a uniform shape due to the deformation during bending. Accordingly, the bent portion 122 may be provided at a portion of the inner circumferential surface of the nozzle cap 120*b*.

The bent portion 122 may be engaged with a depressed portion 133 formed in the outer circumferential surface of the nozzle portion 110 such that the inner end of the bent portion 122 is engaged with a protruding portion 131 formed on the outer circumferential surface 1101 of the nozzle portion 110 in a hook engagement manner.

The metal nozzle cap 120*b* including the bent portion 122 may include a stainless steel material such as a SUS material. The metal nozzle cap 120 may be coupled to the nozzle mesh 121 by means of bonding.

Description regarding other features of this embodiment, which are not disclosed with reference to FIG. 8, may be replaced with the corresponding ones disclosed with reference to FIGS. 5 to 7 without exceeding the scope of the present invention.

Figure 9:
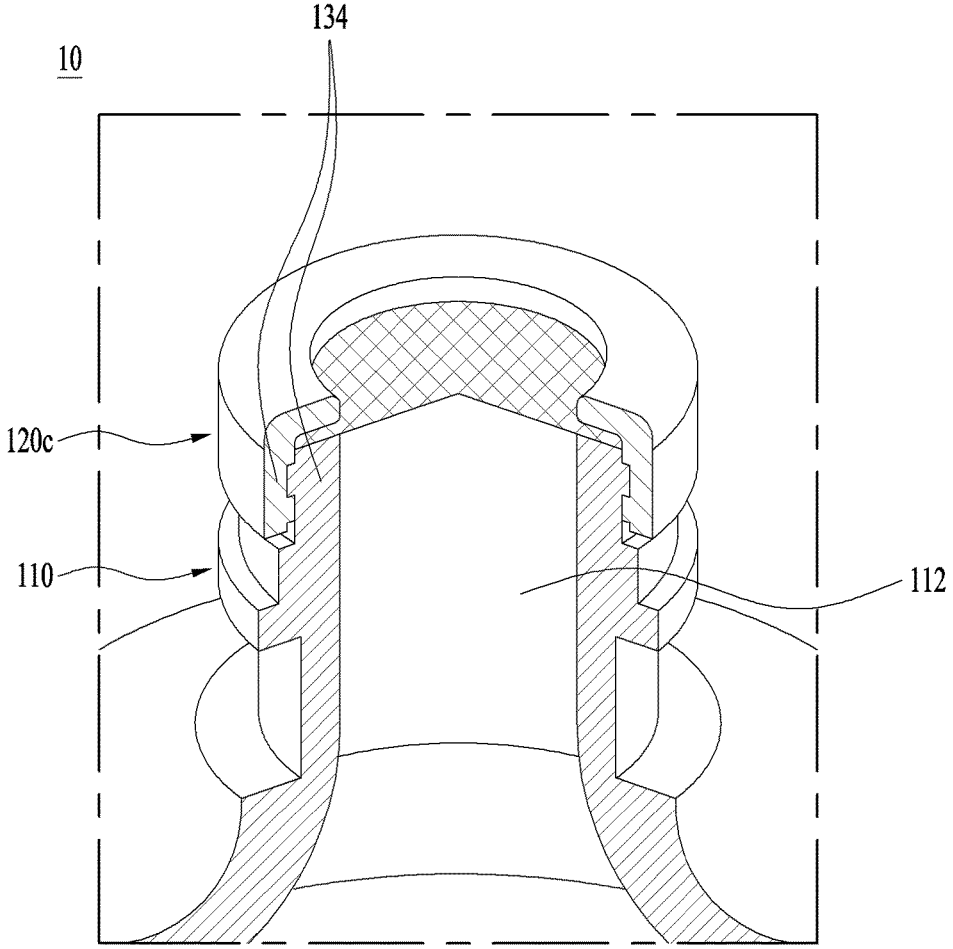
FIG. 9 is a perspective view of an earphone according to a further embodiment of the present invention, shown in a partial breakaway view.

FIG. 9 is a perspective view of an earphone 10 according to a further embodiment of the present invention, shown in a partial breakaway view.

In FIGS. 5 to 8, the embodiment in which the nozzle cap 120 is coupled to the nozzle portion 110 in a hook engagement manner has been described. Unlike the previous embodiment, the embodiment shown in FIG. 9 employs coupling in a screw engagement manner.

The nozzle cap 120*c* may be coupled to the nozzle portion 110 by screw engagement. Specifically, the inner circumferential surface of the nozzle cap 120*c* and the outer circumferential surface of the nozzle portion 110 may be respectively provided with corresponding threads 134 such that the nozzle cap 120*c* is capable of being detachably coupled to the nozzle portion 110 by rotation of the nozzle cap 120*c*.

When the threads 134 are respectively provided on the inner circumferential surface of the nozzle cap 120*c* and the outer circumferential surface of the nozzle portion 110, the internal structure and shape of the sound hole 112 are not changed, like the previous embodiments. Consequently, it is possible to minimize the generation of noise which may affect acoustic characteristic.

The nozzle cap 120*c* may be made of a metal material. Particularly, the nozzle cap 120*c* may include an aluminum material. The nozzle cap 120 may be fixed to the nozzle mesh 121 by means of bonding.

As for other features, the corresponding features disclosed in the embodiment shown in FIGS. 5 to 8 may be applied as long as there is no contradiction therebetween.

When the nozzle cap 120 is coupled to the nozzle portion 110 in a hook engagement manner, the length of the sound hole 112 in the nozzle may be maintained without change, unlike the coupling in a screw engagement manner. In other words, in the case of coupling of the nozzle cap 120 in a hook engagement manner, there is only a choice of whether the nozzle cap 120 is coupled or removed, and the extent to which the nozzle cap 120 is fastened cannot be controlled. In the case of coupling the nozzle cap 120 in a screw engagement manner, since the length of the sound hole 112 varies depending on the extent to which the nozzle cap 120 is fastened, the variation in the length of the sound hole 112 may have an unexpected influence on the sound characteristic.

Accordingly, the earphone 10, which uses the hook-type coupling, may minimize unexpected influence on sound characteristic.

Hence, in the earphone 10 which employs the hook-type coupling, the length of the sound hole 112 may be used as a factor influencing the sound characteristics. In addition, since the screw-type coupling entails a lower possibility of the nozzle cap 120 being separated than the hook-type coupling, it is possible to improve the coupling reliability between the nozzle cap 120 and the nozzle portion 110.

Figure 10:
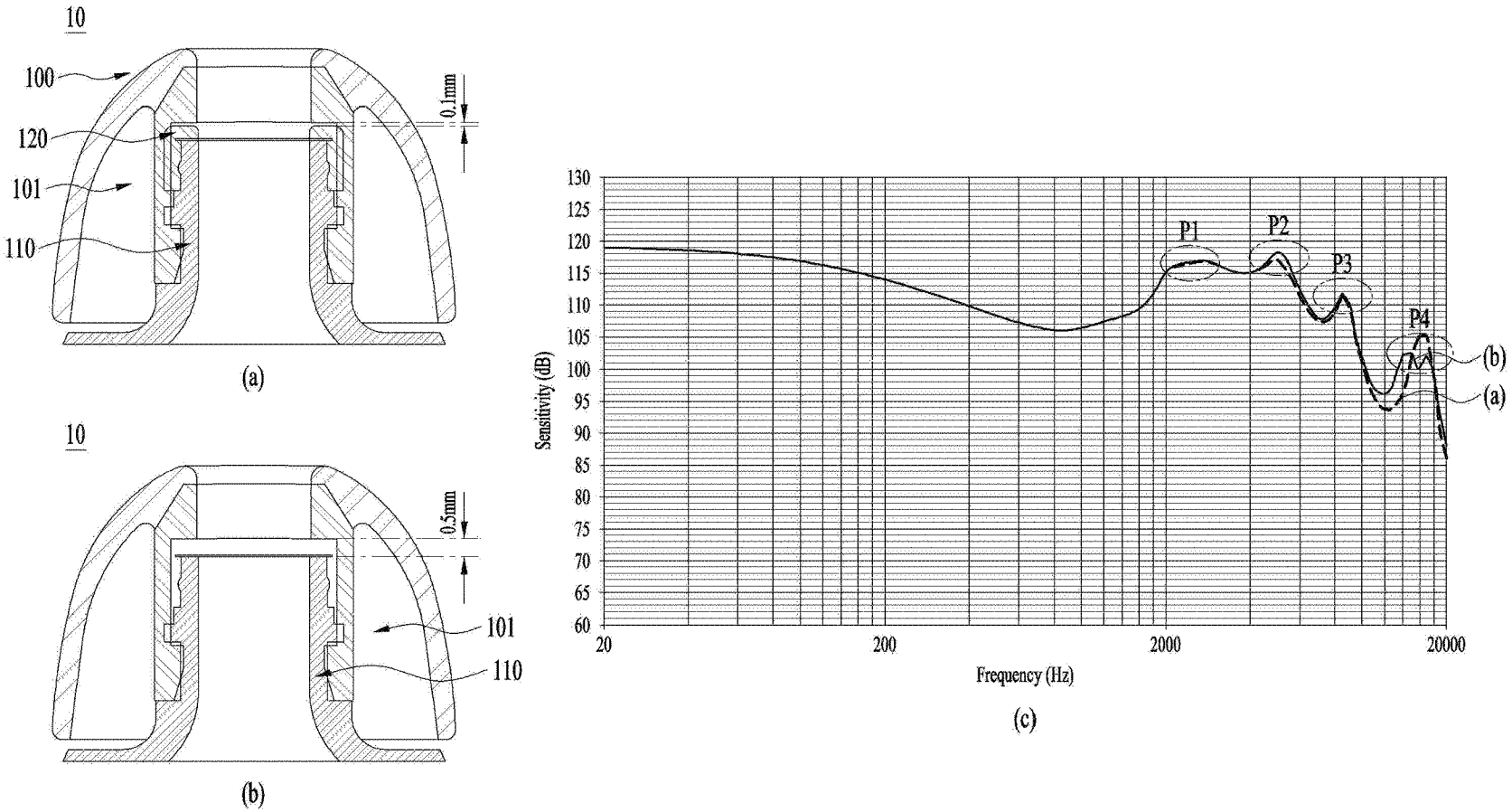
FIG. 10 is a graph illustrating the sound characteristics of the earphone according to the present invention.

FIG. 10 illustrates the earphone 10 according to the present invention and a graph representing sound characteristics over frequency range depending on the presence of the nozzle cap of the earphone 10 according to the present invention.

FIG. 10(*a*) illustrates the earphone 10 according to the present to which the hook-type nozzle cap 120 is coupled, FIG. 10(*b*) illustrates the earphone 10 to which the nozzle cap 120 is not coupled, and FIG. 10(*c*) illustrates sound characteristics over frequency range of the earphones shown in FIGS. 10(*a*) and 10(*b*).

In order to clarify the difference in sound characteristics due to provision of the nozzle cap 120, it is assumed that the length of the sound hole 112, that is, the length between one end of the driver 200 in the output direction of sound and the end of the ear tip 101, is constant.

From FIG. 10(*c*) illustrating a graph representing output over frequency range, it is appreciated that a plurality of peaks P1-P4 occur from a frequency range of 2 kHz (or 1 kHz, not illustrated) regardless of whether the earphone 10 is the earphone shown in FIG. 10(*a*) or the earphone shown in FIG. 10(*b*). For the convenience of explanation, the peaks are numbered with ordinal numbers from a frequency of 2 kHz.

As illustrated in the drawing, the earphone 10 that uses the nozzle cap 120 represents a low output and a relatively gentle curve at the second peak P2 in comparison with the earphone 10 that does not adopt the nozzle cap 120. This indicates that the earphone 10 that uses the nozzle cap 120 provides stable output in midrange and treble frequency range.

Referring to the fourth peak P4, both the curves represent relatively low outputs in comparison with other ranges. Accordingly, it is required to maximize output at the frequency of the fourth peak P4. At the fourth peak P4, the earphone 10 that uses the nozzle cap 120 provides a higher output than the earphone 10 that does not adopt the nozzle cap 120. This implies that the earphone 10 that uses the nozzle cap 120 is able to increase the relative output in a treble frequency range, unlike the earphone 10 that does not adopt the same.

Furthermore, the earphone 10 that uses the nozzle cap 120 provides the output behavior at the fourth peak P4, which is maintained over a wider frequency range than the earphone 10 that does not use the nozzle cap 120.

Accordingly, the earphone 10 that uses the nozzle cap 120 offers an advantage of representing uniform properties over the entire range in comparison with the earphone 10 that does not adopt the nozzle cap 120.

Figure 11:
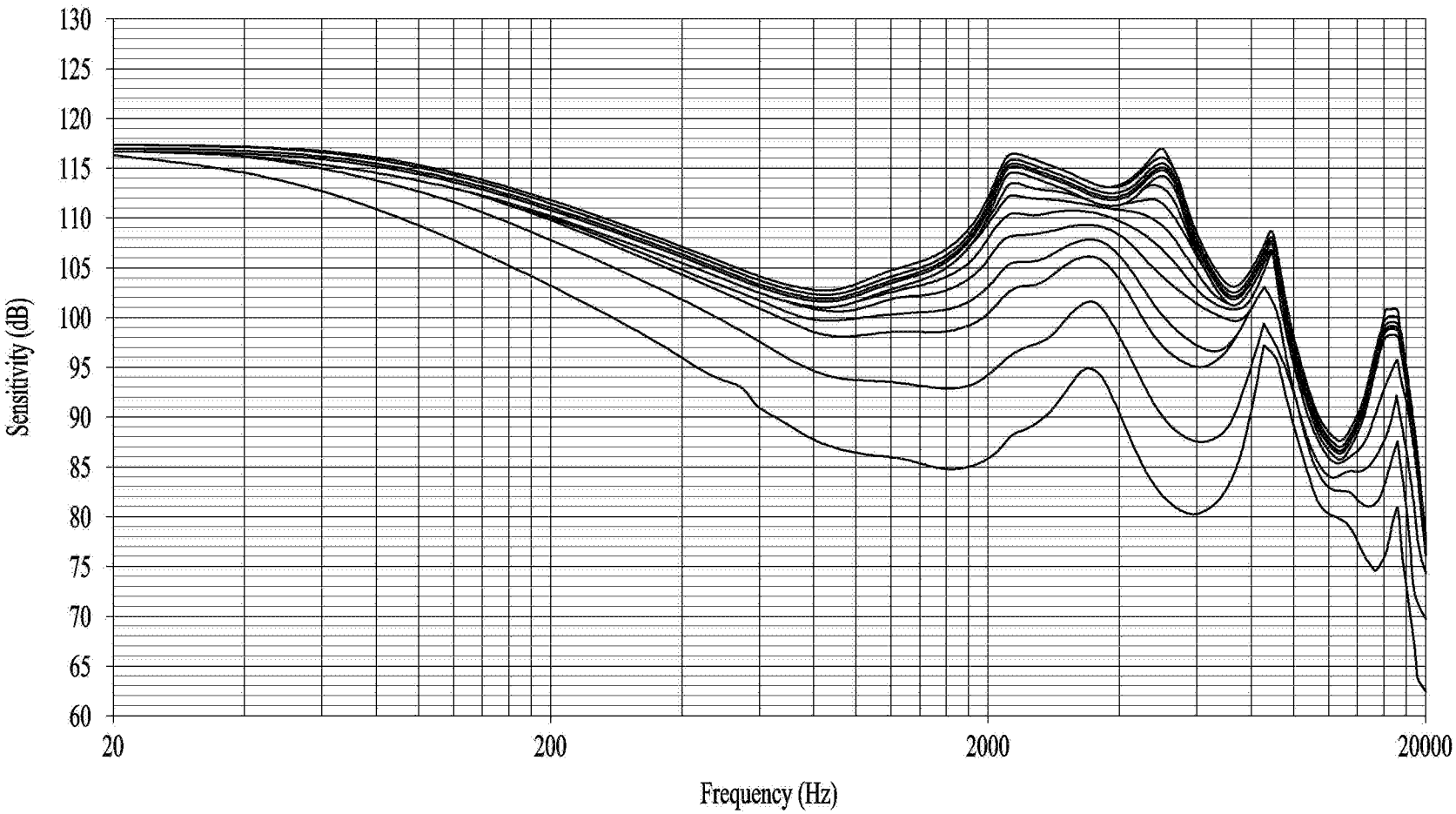
FIG. 11 is a graph illustrating sound characteristics over frequency range depending on the configuration of the nozzle mesh according to the present invention.

FIG. 11 is a graph illustrating sound characteristic over frequency range depending on configuration of the nozzle mesh 121 according to the present invention.

The nozzle mesh 121 may change the sound pressure of the earphone 10 depending on the material of the nozzle mesh, the thickness of the mesh wire of the nozzle mesh, the density of the mesh wire and the like. This implies that the nozzle mesh 121 is able to control the output characteristics of the earphone 10.

Particularly, the mesh density of the nozzle mesh 121, that is, the distance between adjacent mesh wires of the nozzle mesh 121, may have the greatest influence on sound characteristics. As the mesh density is increased, the sound pressure is increased, thereby lowering output in the center frequency range of 20 Hz to 20 kHz. Accordingly, these properties of the nozzle mesh may be used in tuning of sound characteristics in the concerned frequency range.

Figure 12:
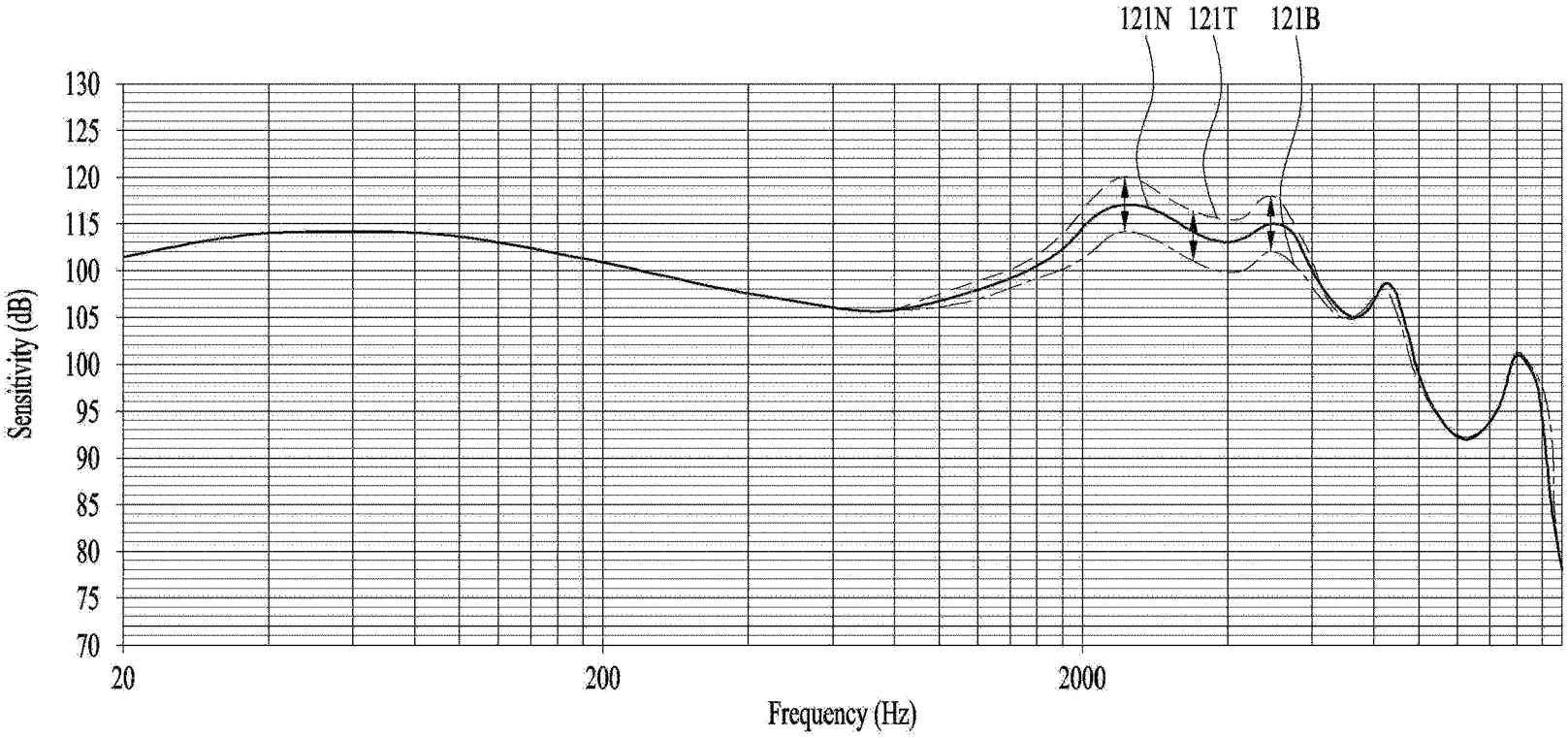
FIG. 12 is a graph illustrating sound characteristic over frequency range depending on the configurations of the nozzle cap and the nozzle mesh according to the present invention.

FIG. 12 is a graph illustrating sound characteristic over frequency range depending on configurations of the nozzle cap 120 and the nozzle mesh 121.

The earphone according to the present invention may be embodied as an earphone package including the replaceable nozzle cap 120, which is able to change sound characteristics using the difference in physical properties of the nozzle mesh and provision of the replaceable nozzle cap 120.

For example, the housing 100 including the nozzle portion 110 may be provided with a first nozzle cap 120, a second nozzle cap 120 and a third nozzle cap 120, all of which are interchangeable. The first to third nozzle caps 120 may include nozzle meshes 121 having different specifications so as to realize earphones 10 having different sound characteristics, as illustrated in FIG. 10.

As described in FIG. 11, since the nozzle mesh 121 has the greatest influence on output in the center portion in 20 Hz-20 kHz, the nozzle mesh 121, which is provided in the nozzle cap 120, has a main role of effecting output in a frequency range of 500 Hz or higher, particularly a frequency range of 2 kHz-6 kHz.

In an example, the first to third nozzle caps 120 may include the nozzle meshes 121, which respectively affect base, midrange and treble sound characteristics.

The bass nozzle mesh 121B may provide a relatively low output in the bass frequency range, the treble nozzle mesh 121T may provide a relatively high output in the treble frequency range, and the midrange nozzle mesh 121N may provide an intermediate output bridging between the outputs of the bass nozzle and the treble nozzle. The sound characteristics of bass, midrange and treble may be respectively allocated to the plurality of nozzle meshes 121.

In the frequency range in which the difference in output between the individual nozzle meshes 121 is greatest, there may be difference of at least 3 dB between the output caused by the bass nozzle mesh 121B and the output caused by the midrange nozzle mesh 121N. Also, there may be a difference of at least 3 dB between the output caused by the treble nozzle mesh 121T and the midrange nozzle mesh 121N. The reason why the minimum value of the output difference is 3 dB is because 3 dB has been statically determined to be the value that is perceivable by an ordinary person.

Figure 13:
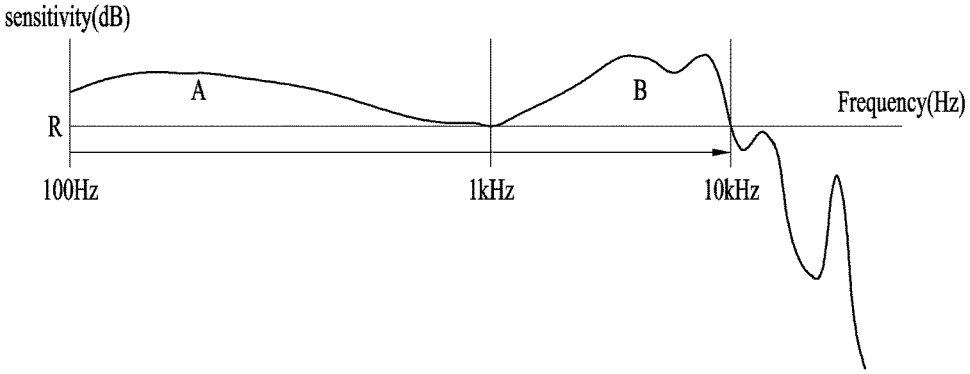
FIG. 13 is a graph illustrating an algorithm for determining sound characteristics over frequency range depending on the nozzle cap and the nozzle mesh according to the present invention.

FIG. 13 is a graph illustrating an algorithm for determining the sound characteristics over frequency range depending on the nozzle cap 120 and the nozzle mesh 121 according to the present invention.

The nozzle mesh 121 mainly changes the central frequency range in an audible frequency range. However, there are various factors, which have an influence on the sound characteristic of the earphone 10. Accordingly, it is difficult to specify the bass characteristics, the midrange characteristics and the treble characteristics using only the specification of the nozzle mesh 121.

Accordingly, there is a need to define the bass characteristics, the midrange characteristics and the treble characteristics within 20 Hz-20 kHz, which is the audible frequency range.

In a graph showing output characteristics at 20 Hz-20 kHz, which is the audible frequency range, when it is assumed that the output value corresponding to 1 kHz is designated as R, the area of the output value between 100 Hz to 1 kHz is designated as A and the area of the output value between 1 kHz to 10 kHz is designated as B, the case where the value of B/(A+B) is less than 0.35 may exhibit sound characteristics of base, the case where the value of B/(A+B) is 0.35 to 0.65 may exhibit sound characteristics of midrange, and the case where the value of B/(A+B) exceeds 0.65 may exhibit sound characteristics of treble.

Accordingly, the specifications of the first nozzle cap 120, the second nozzle cap 120 and the third nozzle cap 120, that is, the specifications of the nozzle meshes 121 of the respective nozzle caps 120, may be selected based on the respective sound characteristics.

Figure 14:
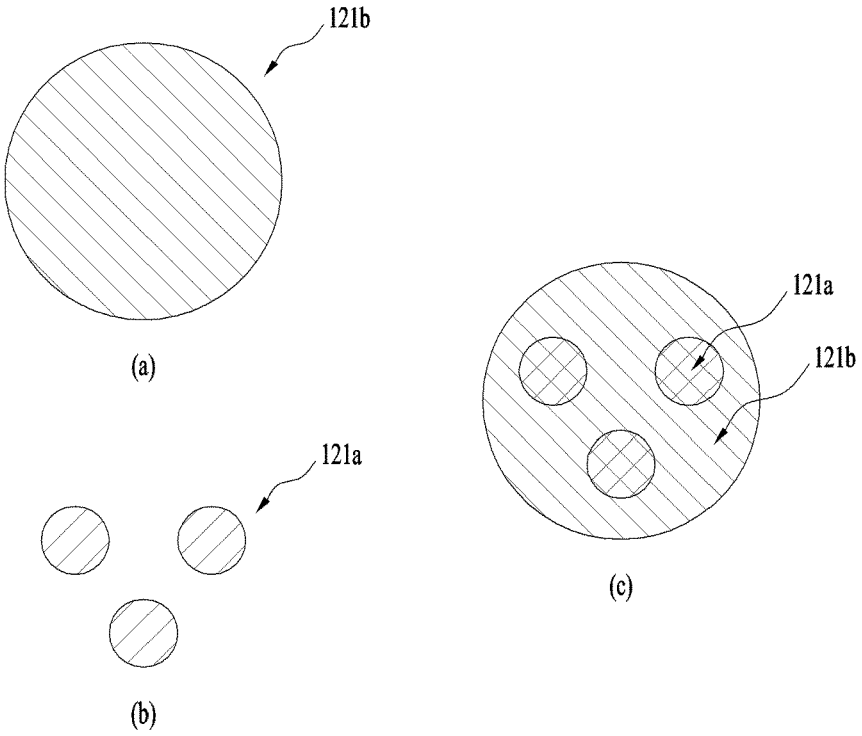
FIG. 14 is a view illustrating another embodiment of the nozzle mesh of the earphone according to the present invention.
Figure 15:
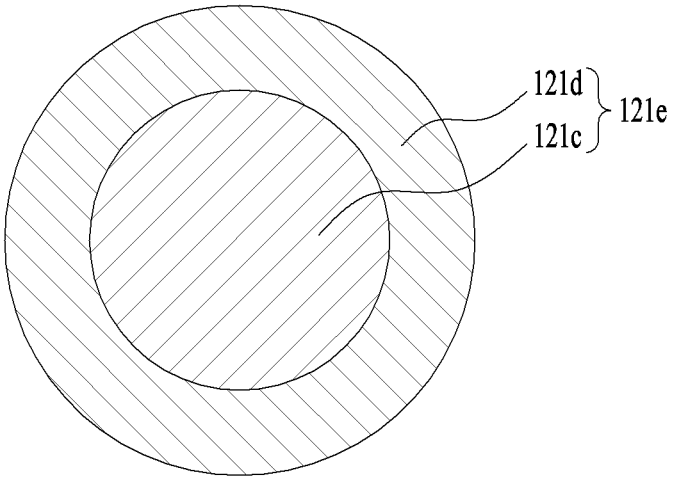
FIG. 15 is a view illustrating a further embodiment of the nozzle mesh of the earphone according to the present invention.
Figure 16:
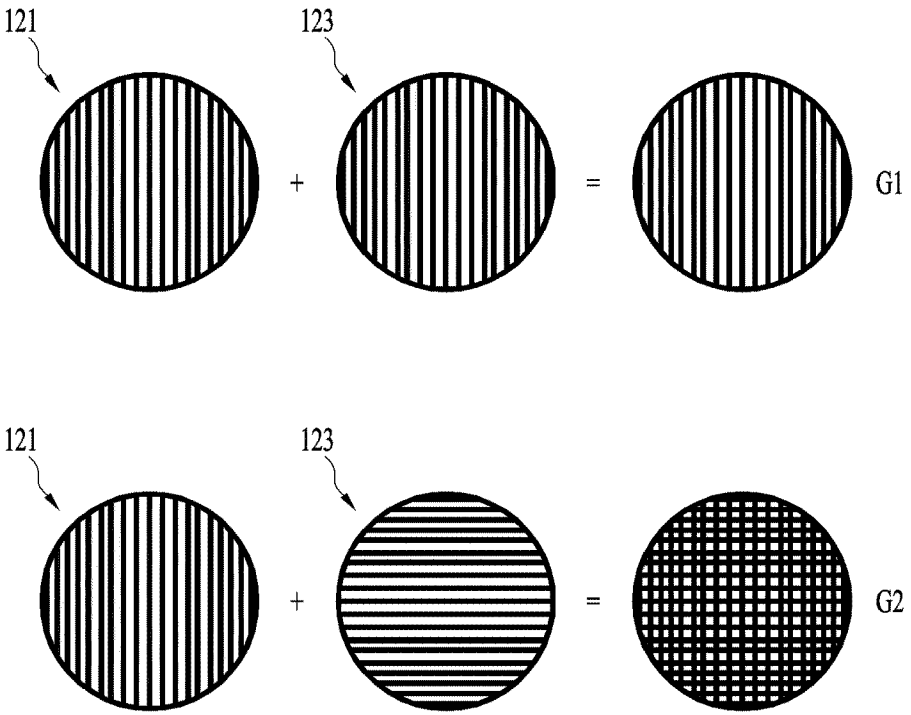
FIG. 16 is a view illustrating yet a further embodiment of the nozzle mesh of the earphone according to the present invention.
Figure 16:
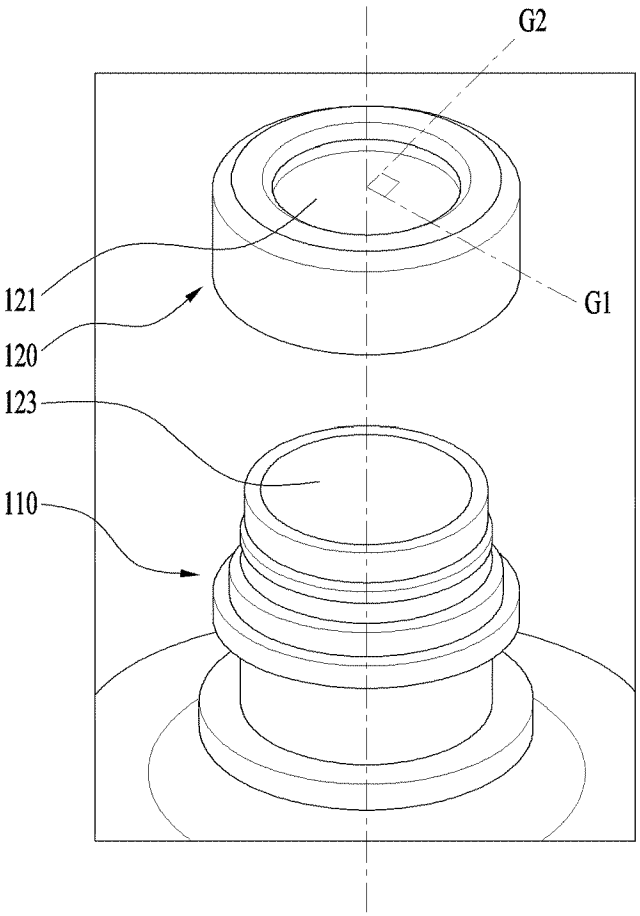

FIGS. 14 to 16 illustrate a scheme to realize a precise or variable sound characteristic using a complex nozzle mesh 121.

FIG. 14 illustrates another embodiment of the nozzle mesh 121 of the earphone 10 according to the present invention.

The previous embodiment is characterized that a single nozzle cap 120 is provided with a single nozzle mesh 121. The term "nozzle mesh" used herein refers to a mesh having a small mesh size, which does not have an influence on sound characteristics, but does not refer to the above-mentioned cover mesh.

Alternatively, the nozzle mesh 121 may be composed of a plurality of nozzle meshes 121, which overlap each other, when necessary. In the case in which the nozzle mesh 121 is composed of a plurality of nozzle meshes 121, it is significant in that it is possible to create a negative pressure, which would not otherwise be realized by a conventional nozzle mesh having a limited specification.

In light of physical condition or productivity, there is a limit to the minimum distance between mesh wires of the nozzle mesh 121. Accordingly, when the nozzle mesh 121 is composed of a plurality of producible nozzle meshes, which overlaps each other, there is an advantage of being able to realize a high sound pressure, which could otherwise not be realized by a single conventional nozzle mesh 121.

Particularly, in the case in which the nozzle mesh 121 is composed of a pair of overlapping nozzle meshes, one of the pair of nozzle meshes is referred to as a first nozzle mesh 121*a* and the other of the pair of nozzle meshes is referred to as a second nozzle mesh 121*b*.

The first nozzle mesh 121*a* and the second nozzle mesh 121*b* may be disposed to overlap each other on at least a portion thereof.

For example, when the second nozzle mesh 121*b* is placed on the upper surface of the first nozzle mesh 121*a*, the first nozzle mesh 121*a* may be positioned at a portion of the first region defined by the second nozzle mesh 121*b*. In an embodiment, the first region may include a plurality of circular regions.

When the second nozzle mesh 121*b* covers the entire opening in the sound hole 112 and the first nozzle mesh 121*a* is provided on a partial region of the opening, that is, the first region, there is an advantage of being able to slightly increase the sound pressure caused by the second nozzle mesh 121*b*. In other words, it is possible to finely control sound pressure by adding sound pressure only to the partial region.

FIG. 15 illustrates a further embodiment of the nozzle mesh 121 of the earphone 10 according to the present invention.

Alternatively, two nozzle meshes 121 having different specifications may be provided in the same plane so as to form the same layer. Specifically, two nozzle meshes 121 having different specifications may constitute a single nozzle mesh 121 so as to exhibit the property of a nozzle mesh 121 having a different specification.

For the convenience of explanation, when the two nozzle meshes 121 having different specifications are respectively referred to as a third nozzle mesh 121*c* and a fourth nozzle mesh 121*d*, a resultant fifth nozzle mesh 121*e* that is newly created may have an intermediate sound pressure between a sound pressure caused by the third nozzle mesh 121*c* and a sound pressure caused by the fourth nozzle mesh 121*d*.

In an example, the third nozzle mesh 121*c* may be provided in a second region, which is the central region of the opening in the sound hole 112, and the fourth nozzle mesh 121*d* may be provided in a third region, which is a peripheral region of the sound hole 112 excluding the third nozzle mesh 121*c*.

FIG. 16 illustrates yet a further embodiment of the nozzle mesh 121 of the earphone 10 according to the present invention.

The hook-type nozzle cap 120 is able to be rotated even after coupling. Accordingly, a structure capable of variably controlling the sound pressure caused by the nozzle mesh 121 by the rotatable nozzle cap 120 may be considered.

The nozzle cap 120 may be provided with the nozzle mesh 121, and the opening in the nozzle portion 110 may be provided with a subsidiary nozzle mesh 123. By virtue of the rotatable nozzle cap 120, the nozzle mesh 121 and the subsidiary nozzle mesh 123 may define a variable relative angle.

For example, each of the nozzle mesh 121 and the subsidiary nozzle mesh 123 may be configured to have a pattern composed of a plurality of parallel lines. Accordingly, the pattern composed of the plurality of parallel lines may form parallel linear holes.

When the nozzle cap 120 is rotated to an angle of G1 with respect to the nozzle portion 110, the parallel linear pattern of the nozzle mesh 121 and the parallel linear pattern of the subsidiary nozzle mesh 123 are arranged parallel to each other, thereby forming an airflow hole having the maximum area. Meanwhile, when the nozzle cap 120 is rotated to an angle of G2 with respect to the nozzle portion 110, the parallel linear pattern of the nozzle mesh 121 and the parallel linear pattern of the subsidiary nozzle mesh 123 are oriented perpendicular to each other, thereby forming an airflow hole having the minimum area. The angle difference between the angle of G1 and the angle of G2 may be a right angle.

As the area of the airflow hole is increased, an increasingly lowered sound pressure is created. As the area of the airflow hole is decreased, an increasingly raised sound pressure is created. Accordingly, the area of the airflow hole may have an influence on the sound characteristics.

Consequently, a user may control the sound characteristics by controlling the rotating angle of the nozzle cap 120, that is, the area of the airflow hole, within a range between G1 and G2.

Figure 17:
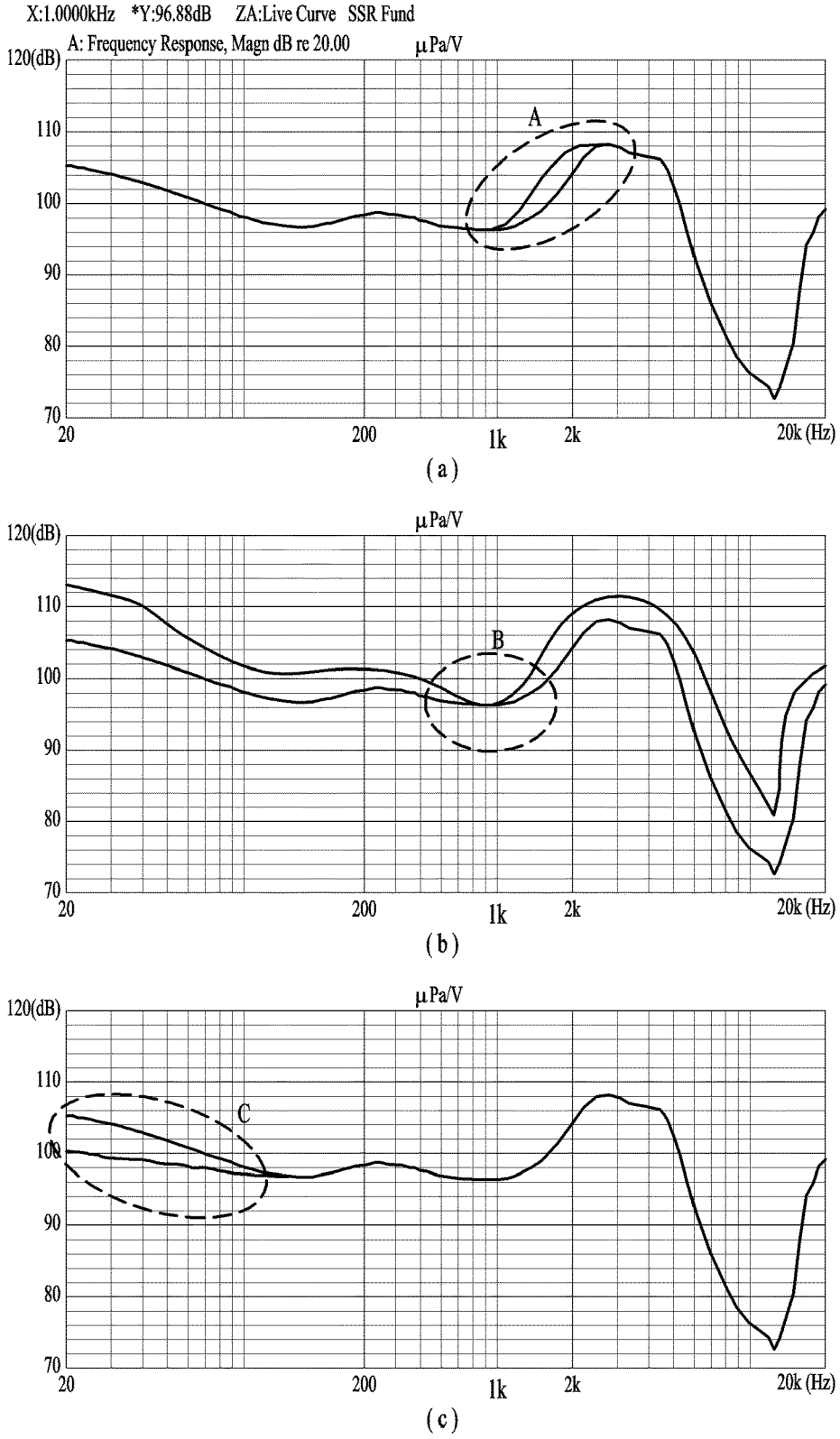
FIG. 17 shows graphs illustrating the sound characteristics over frequency range depending on an airflow amount of the earphone according to the present invention.

FIG. 17 shows graphs illustrating sound characteristics over frequency range depending on the airflow amount of the earphone 10 according to the present invention.

When an airflow amount is controlled, it is possible to change the output in a frequency region A, which is the range from the lowest point right before the first peak, which is the resonant frequency, to a point near the peak. The output in the region A is decreased with reduction in an airflow amount through the nozzle portion 110, and is increased with increase in the output at the region A.

Although FIG. 17(*a*) illustrates the case in which the region A is a region encircling a range of 1 kHz to 2 kHz, the region A is not limited thereto, and may vary depending on the specifications of the earphone 10. These characteristics may also be applied to the descriptions of sound characteristics at regions B and C, which will be set forth below.

As described above, the previous embodiments change sound characteristics by controlling an airflow amount through the nozzle portion 110.

However, the sound characteristic may also be changed not only by controlling an airflow amount through the nozzle portion 110 but also by controlling an airflow amount through other components.

Hereinafter, a scheme to change sound characteristics by controlling an airflow amount through other components of the earphone 10 will be described with reference to the following embodiments.

In an example, sound characteristics may be changed depending on the airflow amount through the driver 200 itself.

When the airflow amount is controlled by the hole formed in the rear surface of the driver 200, the output may be changed in the remaining frequency range other than region B, which is located near 1 kHz, as shown in FIG. 17(*b*). When the airflow amount through the hole formed in the rear surface of the driver 200 is decreased, output in a frequency range lower than region B is decreased whereas output in a frequency range higher than region B is increased. Meanwhile, when the airflow amount through the hole formed in the rear surface of the driver 200 is increased, output in a frequency range lower than region B is increased, whereas output in a frequency range higher than region B is decreased.

In other words, the sound characteristics are changed by controlling the airflow amount through the hole formed in the rear surface of the driver 200 as in the behavior of a seesaw.

In another example, sound characteristics may also be changed depending on the airflow amount through the housing 100 itself.

When the airflow amount is controlled by the hole formed in the housing 100 behind the driver 200, the output may be changed in a region C, which is a low frequency range, as shown in FIG. 17(*c*). When the airflow amount through the hole formed in the housing 100 behind the driver 200 is decreased, output in a frequency range at region C is decreased. Meanwhile, when the airflow amount through the hole formed in the housing 100 behind the driver 200 is increased, the output in a frequency range at region C is increased.

Figure 18:
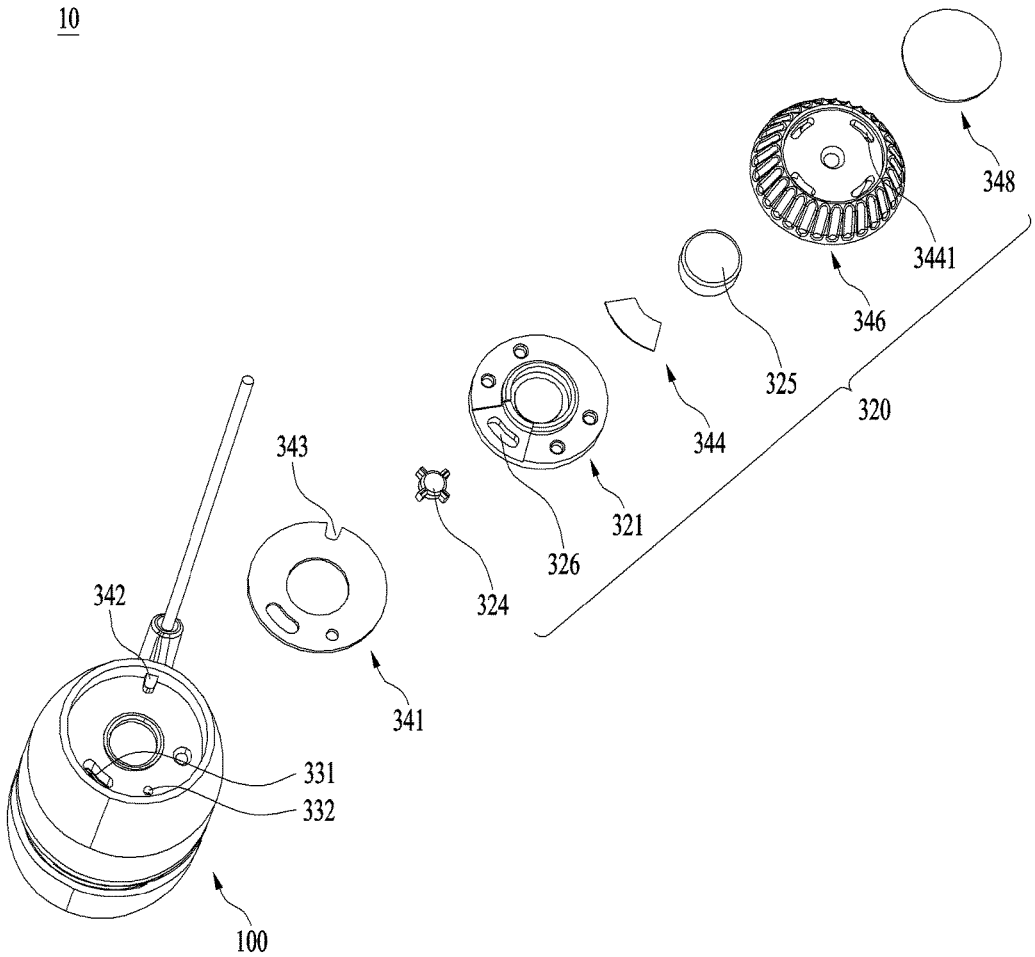
FIG. 18 is an exploded perspective view of the earphone according to the present invention.

FIG. 18 is an exploded perspective view of the earphone 10 according to the present invention.

The housing 100 may include a bass hole 331 and a flat hole 332. Specifically, the bass hole 331 and the flat hole 332 may be provided in a first surface of the housing 100, and the first surface may be the rear surface of the housing 100.

Owing to the bass hole 331 and the flat hole 332 provided in the rear surface of the housing, sound characteristics may be changed by rotating a rotating unit 320 coupled to the rear surface of the housing 100.

The rotating unit 320 is provided therein with an opening hole 326. The opening hole 326 opens and closes by rotation of the rotating unit 320 so as to realize different sound characteristics. When the opening hole 326 is aligned with the bass hole 331 so as to open the bass hole 331, sound having the characteristic of boosted bass is generated. Meanwhile, when the opening hole 326 is aligned with the flat hole 332 so as to open the flat hole 332, sound having characteristics in which boosted treble is generated.

The characteristics of the bass booster and the treble booster are merely examples of sound characteristics that can be realized by the earphone according to the present invention. Various sound characteristics may be variously changed depending on the shapes or sizes of the holes.

The opening hole 326 may be provided in a second surface of the rotating unit 320. The term "second surface" refers to the surface that faces the first surface of the housing 100. The second surface may be defined by an inner bracket 321 of the rotating unit 320.

The inner bracket 321 may be configured to be directly coupled to the housing 100 and to be rotated. A detailed description thereof will be given later.

The bass hole 331 and the flat hole 332 enable different airflow amounts relative to the enclosure of the housing 100. Since the bass hole 331 has a relatively large area, the airflow amount through the bass hole 331 is larger than that through the flat hole 332. Since the flat hole 332 has a relatively small area and has a channel structure, which is described below, the airflow amount through the flat hole 332 is smaller than that through the bass hole 331.

Generally, as an airflow amount is decreased, the base characteristic is also decreased. Although this may be achieved by reducing the size of the hole, it is impossible to unlimitedly reduce the size of the hole in light of manufacturing process. Accordingly, a channel structure may be provided in order to control an airflow amount.

Figure 19:
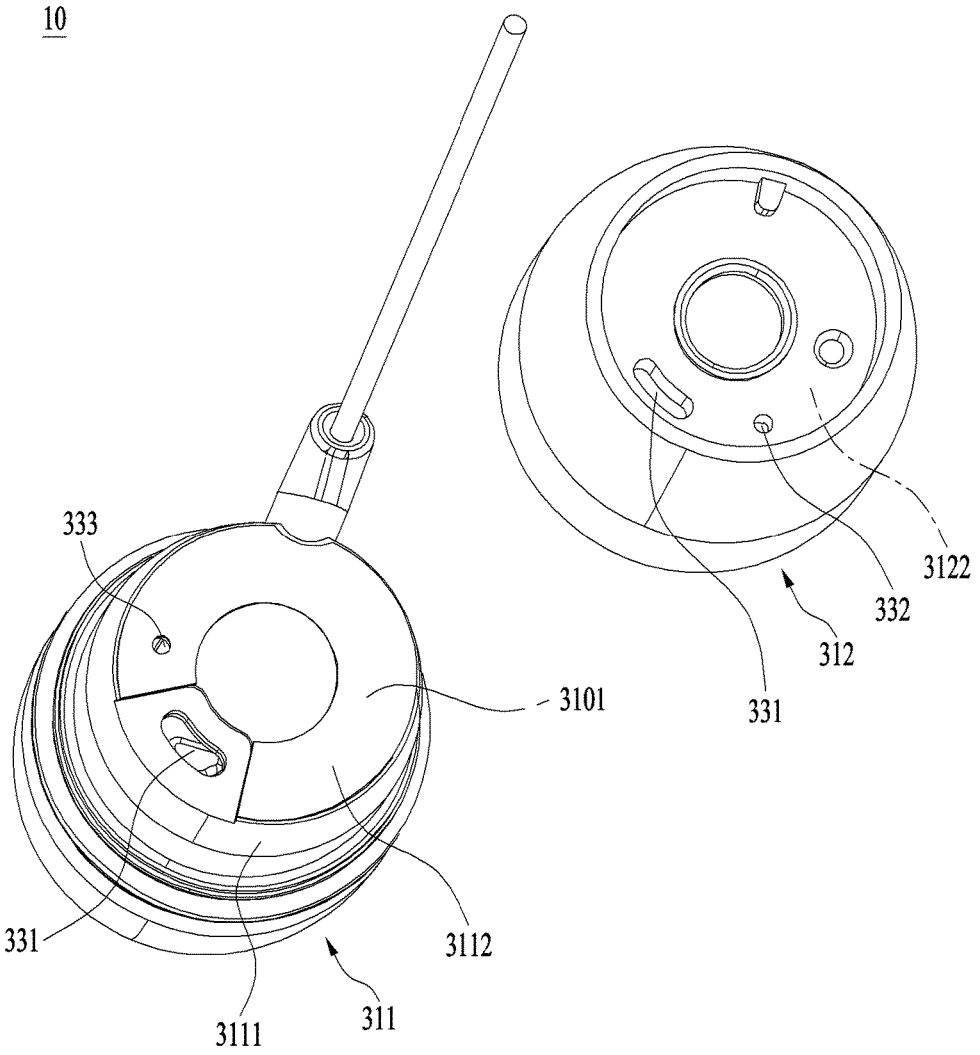
FIG. 19 is a fragmentary exploded perspective view of the earphone according to the present invention.
Figure 20:
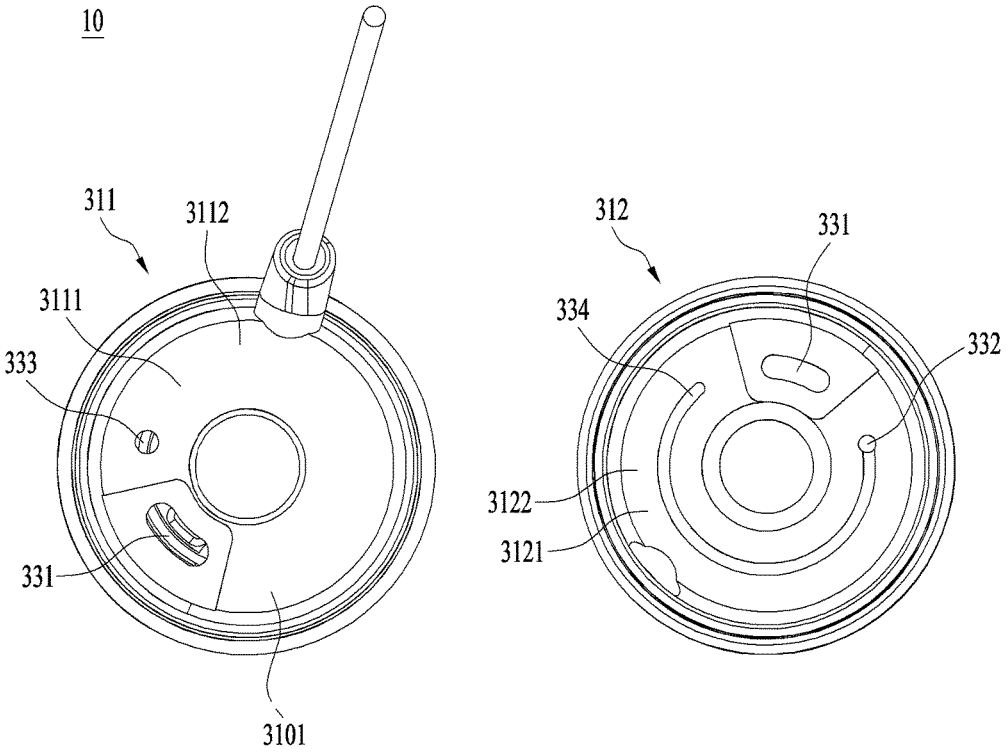
FIG. 20 is a front view illustrating the outer side of an inner case and the inner side of the outer case.

FIG. 19 is a fragmentary exploded perspective view of the earphone 10 according to the present invention, and FIG. 20 is a front view illustrating the outer side of an inner case 311 and the inner side of the outer case 312. For the convenience of explanation, the following description will be given with reference to both FIG. 19 and FIG. 20.

The housing 100 may include the inner case 311, which directly defines an electrical component mount 3101 on which components, such as the driver 200, are mounted, and the outer case 312, which is coupled to the inner case 311 so as to cover the outer surface 3111 of the inner case 311. The inner surface of the outer case 312 may be coupled to the outer surface 3111 of the inner case 311.

As described, since unlimited reduction of the size of the flat hole 332 is impossible, it is possible to reduce an airflow amount by means of the flat hole 332 formed in the outer case 312, particularly a hole plate 3122, and an inner hole 333 formed in the inner case 311, particularly a damper layer 3112.

When the outer case 312 is coupled to the inner case 311, the flat hole 332 is not aligned with the inner hole 333. In other words, the flat hole 332 and the inner hole 333 communicate with each other through a channel groove 334 formed in the inner surface 3121 of the outer case 312.

The inner surface 3121 of the outer case 312 is closed at the remaining area thereof excluding the channel groove 334 by the outer surface 3111 of the inner case 311. Consequently, the air in the electrical component mount on which the driver 200 is provided, that is, the air in the enclosure may flow through the inner hole 333, the channel groove 334 and the flat hole 332 in that order, and may then be discharged to the outside, or may flow in the reverse direction.

The channel groove 334 defines a depressed region in the inner surface 3121 of the outer case 312. The channel groove 334 may be configured to have a "C" shape so as to enable the inner hole 333 to communicate with the flat hole 332. However, the channel groove 334 may be configured to have other shapes depending on the length of the channel.

When the inner case 311 is coupled to the outer case 312, the bass hole 331 in the inner case 311 and the bass hole 331 in the outer case 312 may be aligned with each other. In other words, the bass hole 331 in the inner case 311 directly communicates with the bass hole 331 in the outer case 312 without providing an additional path. Consequently, the air in the electrical component mount 310 may be directly discharged to the outside or introduced thereinto through the bass holes 331 in the inner case 311 and the outer case 312. As a result, an amount of air which is discharged from or introduced into the enclosure, that is, an airflow amount may be increased, compared to the case in which the air flows through the flow channel including the flat hole 332.

Referring again to FIG. 18, a sealing gasket 341 is provided between the first surface of the housing 100 and the second surface of the rotating unit 320. When the opening hole 326 is aligned with the flat hole 332 or the bass hole 331 and thus opens the hole, the sealing gasket 341 prevents the generation of unintended noise due to leakage of air through the remaining area excluding the hole.

The sealing gasket 341 may be provided at points thereof corresponding to the flat hole 332 and the bass hole 331 with holes that have the same shapes as the flat hole 332 and the bass hole 331. In order to prevent relative movement between the sealing gasket 341 and the housing 100, the first surface of the housing 100 may be provided with a holding protrusion 342 and the sealing gasket 341 may be provided with a holding groove 343 corresponding in shape to the holding protrusion 342.

The inner bracket 321 of the rotating unit 320 is coupled to a rotating dial 346 and is rotated therewith. The opening hole 326 in the inner bracket 321 is aligned with one of the bass hole 331 and the flat hole 332 and thus opens the hole so as to allow the air in the enclosure to be discharged and introduced only through the one of the bass hole 331 and the flat hole 332.

If necessary, the opening hole 326 may be provided with a first venting mesh 344 so as to additionally reduce an airflow amount through the opening hole 326.

The rotating dial 346 may be coupled to the rear surface of the inner bracket 321. The rotating dial 346 may be provided on the outer circumferential surface thereof with a predetermined pattern so as to allow a user to easily grasp and rotate the rotating dial 346.

The rotating dial 346 may include at least one hole 3441 for controlling an airflow amount and a second air-flowing mesh 348 covering the hole 3441.

Figure 21:
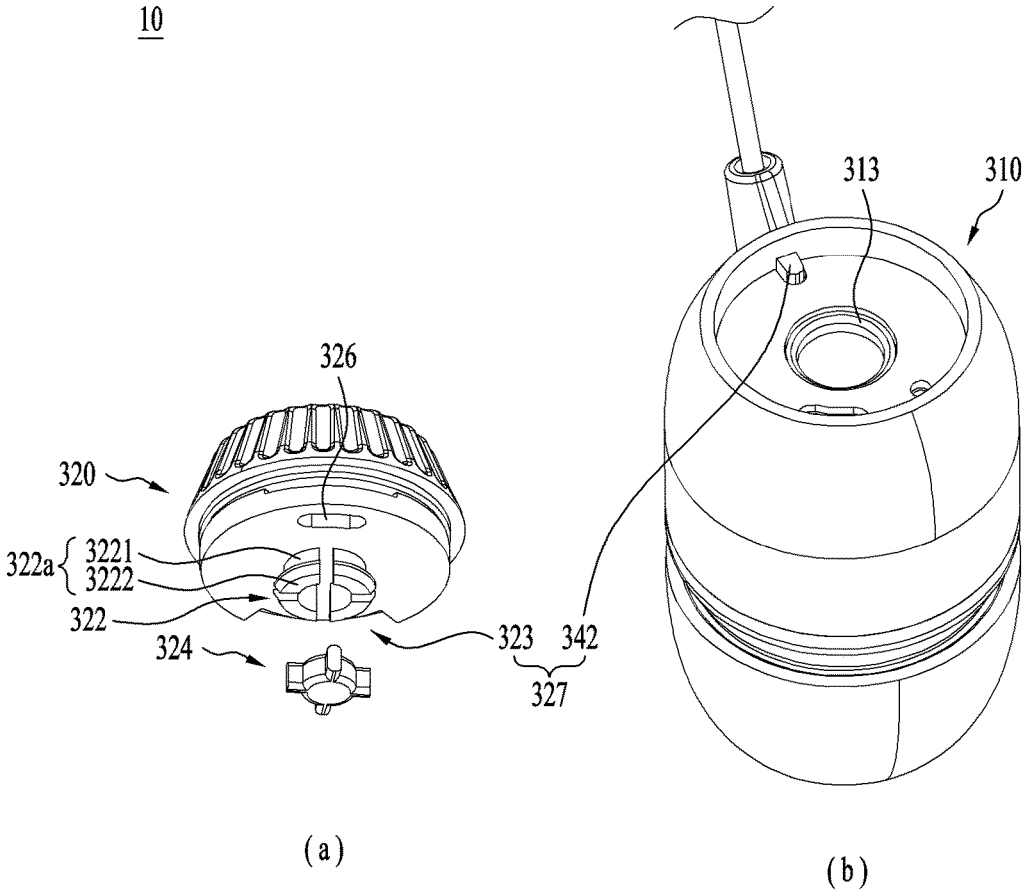
FIG. 21 illustrated a rear perspective view of the rotating unit and a front perspective view of the housing.
Figure 22:
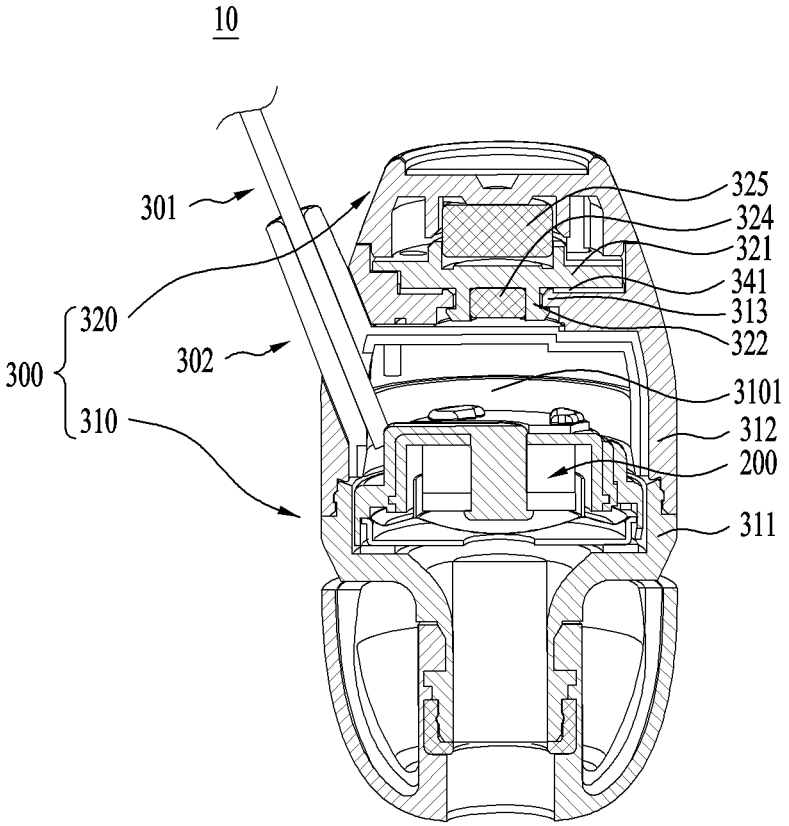
FIG. 22 is a longitudinal cross-sectional view of the earphone according to the present invention.

FIG. 21 illustrates a rear perspective view of the rotating unit 320 and a front perspective view of the housing 100. In particular, FIG. 21(*a*) is a rear perspective view of the rotating unit 320 and FIG. 21(*b*) is a front perspective view of the housing 100. FIG. 22 is a longitudinal cross-sectional view of the earphone 10 according to the present invention. For the convenience of explanation, the following description will be given with reference to both FIG. 21 and FIG. 22.

As described above, the rotating unit 320 is rotatably coupled to the housing 100. The housing 100 may include a coupling flange 313 defining a circular opening therein. A rotating hook portion 322 of the rotating unit 320 is coupled to the coupling flange 313 through hook engagement, and is rotated along the inner circumferential surface of the coupling flange 313.

The outer circumferential surface 3221 of the rotating hook portion 322 may be engaged with the inner circumferential surface of the coupling flange 313 so as to guide rotation of the rotating unit 320.

A hook 3222 of the rotating hook 322 may be disposed in and engaged with a hole in the coupling flange 313.

A rotating angle of the rotating unit 320 may be limited by a guide stepped groove 323 of the rotating unit 320 and the holding protrusion 342 provided on the first surface of the housing 100.

When the rotating unit 320 is rotated to one end or the other end of a first angular range, opposite ends of the guide stepped groove 323 are caught by the holding protrusion 342, whereby the rotating unit 320 is able to rotate within the first angular range.

The rotating hook 322 may include a plurality of hook protrusions 322*a*. The plurality of hook protrusions 322*a* is spaced apart from each other so as to exhibit the elasticity required for the hook engagement. When the rotating unit 320 is coupled to the housing 100, the plurality of hook protrusions 322*a* may converge to the center so as to allow the rotating hook 322 to pass through the opening in the coupling flange 313. After the rotating unit 320 is coupled to the housing 100, the plurality of hook protrusions 322*a* may be restored and engaged in the coupling flange 313 again by means of elastic restoring force.

However, there may be the case in which the plurality of hook protrusions 322*a* are not completely restored to the initial state and are not completely coupled to the housing 100 due to manufacturing tolerance or physical deformation of the rotating hook 322. This case may cause simple movement or displacement between components and may have an influence on an airflow amount, thereby having an unintended influence on sound output.

A support rubber 324 serves to expand the plurality of hook protrusions 322*a* outward so as to prevent the hook protrusions 322*a* from being maintained in the converged state after compression thereof or from being insufficiently expanded due to physical properties thereof. The support rubber 324 may be made of an elastic material.

Since the plurality of hook protrusions 322*a* are sufficiently expanded, it is possible to prevent formation of a gap between the first surface of the rotating unit 320 and the second surface of the housing 100 and to thus minimize noise included in sound output.

Consequently, since the support rubber 324 increases the force required to rotate the rotating unit 320, the rotating unit 320 may be rotated only when sufficient force is applied to the rotating unit 320 by a user.

Figure 23:
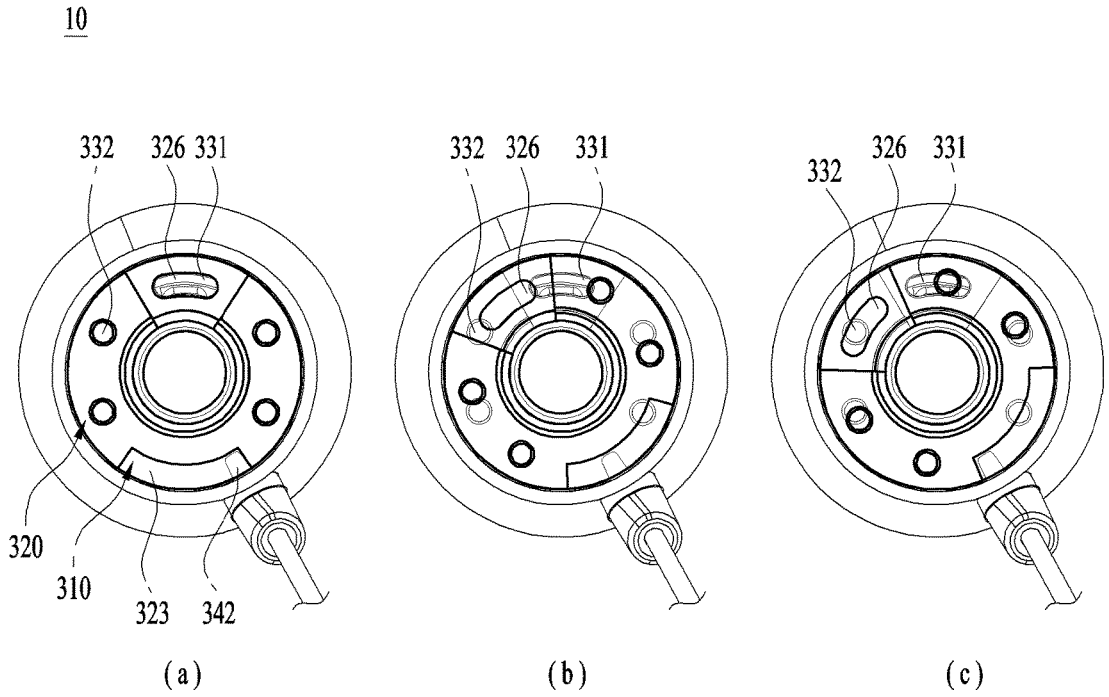
FIG. 23 is a rear view illustrating several states in which the rotating unit is rotated to different angles.

FIG. 23 is a rear view illustrating several states in which the rotating unit 320 is rotated to different angles.

As described above, the rotating unit 320 may be rotated with respect to the housing within the first angular range. The first angular range is determined by the holding protrusion 342 and the width of the guide stepped groove 323.

FIG. 23(*a*) illustrates a first state in which the rotating unit 320 is rotated to one end of the first angular range, FIG.

23(*c*) illustrates a second state in which the rotating unit 320 is rotated to the other end of the first angular range, and FIG. 23(*b*) illustrates a third state between the first state shown in FIG. 23(*a*) and the second state shown in FIG. 23(*c*).

In the first state shown in FIG. 23(*a*), the opening hole 326 is aligned with the bass hole 331 so as to open the bass hole 331, whereas the flat hole 332 is closed. Accordingly, the electrical component mount 3101 of the housing 100, which defines the resonant space, allows the air therein to be discharged and introduced only through the bass hole 331. Here, the shape and size of the opening hole 326 may be set to be equal to or larger than those of the bass hole 331. Accordingly, when air flows through the bass hole 331 in the case in which the bass hole 331 is equal to or larger than the opening hole 326, it is possible to prevent the generation of noise when air flow as intended through the bass hole 331.

In the second state shown in FIG. 23(*c*), the opening hole 326 is aligned with the flat hole 332 so as to open the flat hole 332, whereas the bass hole 331 is closed. Accordingly, the electrical component mount 3101 of the housing 100, which defines the resonant space, allows the air therein to be discharged and introduced only through the flat hole 331. Since the flow path of air through the flat hole 332 has been described above, additional description thereof is omitted.

The shape and size of the opening hole 326 may be equal to or larger than those of the flat hole 332. The reason for this is the same as the reason why the shape and size of the opening hole 326 are equal to or larger than those of the bass hole 331.

In the third state shown in FIG. 23(*b*), the opening hole 326 may simultaneously open a partial area of the bass hole 331 and a partial area of the flat hole 332. Specifically, when the rotating unit 320 is rotated to the second state from the first state, there may be no case in which the opening hole 326 does not communicate with any of the bass hole 331 and the flat hole 332 and both the bass hole 331 and the flat hole 332 are closed.

The reason for this is because an entirely unintended sound effect and thus heterogeneous sound output may be generated when both the bass hole 331 and the flat hole 332 are closed without communication with the opening hole 326. Accordingly, the disposition, shapes and sizes of the components serve to allow the earphone to be smoothly and quickly converted into the second state from the first state.

Referring again to FIG. 22, an ear unit wire 301 electrically connects an ear unit 300 to a main body. The ear unit wire 301 is connected to electrical components of the electrical component mount 3101 of an ear housing 310. The ear unit wire 301, which is led out of the ear housing 310, is enveloped over a predetermined length thereof by a wire support 302 in order to prevent damage to the ear unit wire 301.

The exposed portion of the unit wire 301 and the wire support 302 are provided at a lateral side surface of the ear housing 310. The reason for this is to allow free rotation of the rotating unit 320 without interference.

When the ear unit wire 301 is led out of the lateral side surface of the ear housing 310, the area in the width direction that is occupied by the ear unit 300 is increased. This influences the case in which the ear unit 300 is mounted on the main body.

As a result of the above configuration, a user can change the sound characteristic at region A of FIG. 17 by exchanging nozzle caps equipped with nozzle meshes having different specifications, and can change the sound characteristic at region C of FIG. 17 by controlling the rotating dial 346.

Figure 24:
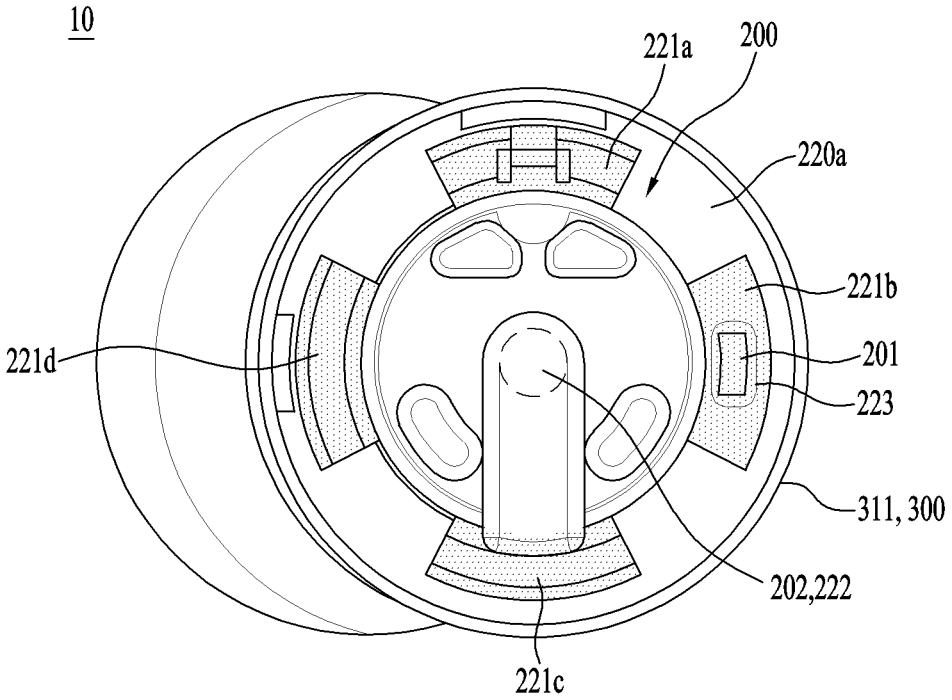
FIG. 24 is a view illustrating the rear surface of the driver according to the present invention.

FIG. 24 illustrates the rear surface of the driver 200 according to the present invention.

The driver 200 is provided in the rear surface thereof with a unit duct hole 201. An airflow amount through the unit duct hole 201 in the driver 200 has an influence on sound characteristics in a frequency range excluding region B of FIG. 17(*b*).

Damper films 221 may be fixed to a first rotating member 220*a*, and may in turn be coupled to the rear surface of the driver 200. The first rotating member 220*a* may be coupled to the rear surface of the driver 200. Specifically, the first rotating member 220*a* may be rotatably coupled to the rear surface of the driver 200.

For example, the first rotating member 220*a* may include a rotating protrusion 222 formed at the rotational axis thereof. The rotating protrusion 222 of the first rotating member 220*a* may be rotatably fitted into a rotating hole 202 in the driver 200.

The damper films 221 may include a plurality of damper films 221*a*, 221*b*, 221*c* and 221*d*, which have different aeration rates. One of the plurality of damper films 221 may be positioned so as to correspond to the unit duct hole 201. The aeration rate of the damper film 221 corresponding to the unit duct hole 201 may have an influence on sound characteristic.

Each of the plurality of damper films 221*a*, 221*b*, 221*c* and 221*d* may be located at the same distance from the rotational axis of the first rotating member 220*a*. By virtue of the disposition of the plurality of damper films 221*a*, 221*b*, 221*c* and 221*d* at the same distance, one of the plurality of damper films 221 may be located at the unit duct hole 201 when the first rotating member 220*a* is rotated.

For the user's convenience, the plurality of damper films 221*a*, 221*b*, 221*c* and 221*d* may be sequentially arranged such that an airflow amount increases or decreases in one direction.

The unit duct hole 201 and the damper film 221 corresponding to the unit duct hole 201 may be in close contact with each other. Specifically, external air may be introduced only through the damper film 221 corresponding to the unit duct hole 201 while the flow of air through other damper films 221 is prevented.

In order to improve reliability of airtightness, a sealing member 223 may be provided along the peripheral boundary of the unit duct hole 201.

The sealing member 223 may be provided between the rear surface of the driver 200 and the first rotating member 220*a* such that one surface of the sealing member 223 is in close contact with the rear surface of the driver 200 and the other surface of the sealing member 223 is in close contact with the inner surface of the first rotating member 220*a*. The sealing member 223 may be coupled to one of the rear surface of the driver 200 and the inner surface of the first rotating member 220*a*.

In order to improve reliability of airtightness, the sealing member 223 may be made of an elastic member.

When necessary, a user may release the coupling between the inner case 311 and the outer case 312 and may then rotate the first rotating member 220*a*.

Alternatively, the first rotating member 220*a* may be partially exposed to the outside from the ear unit 300 so as to immediately control an airflow amount by rotating the first rotating member 220*a* without having to release the coupling of the ear unit 300.

Figure 25:
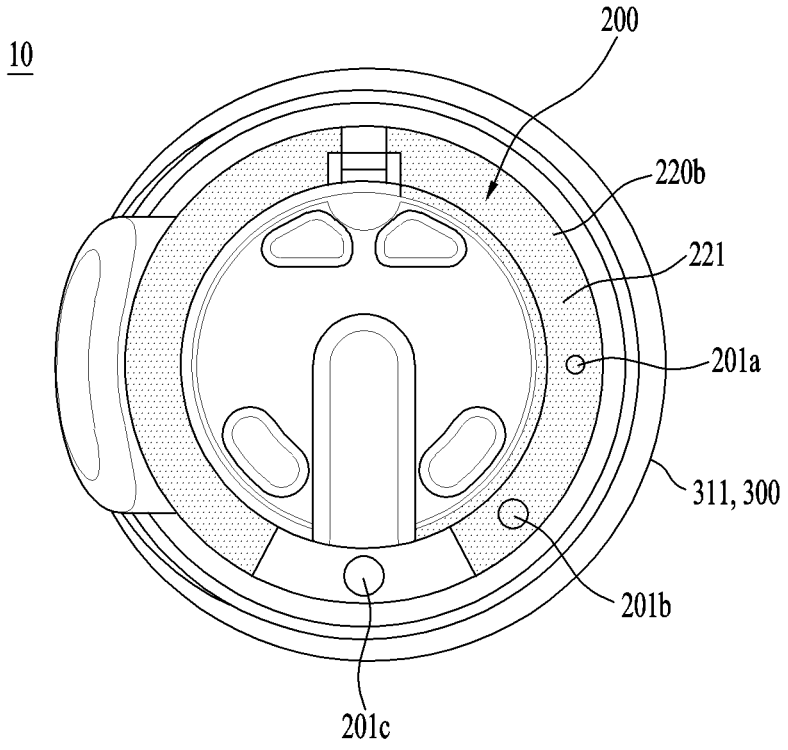
FIG. 25 is a view illustrating the rear surface of a driver according to another embodiment of the present invention.

FIG. 25 illustrates the rear surface of a driver 200 according to another embodiment of the present invention.

Although the previous embodiment illustrates the case in which a plurality of damper films 221*a*, 221*b*, 221*c*, and a single unit duct hole 201 are provided, the case in which a single damper film 221 and a plurality of unit duct holes 201 are provided may also be considered.

The driver 200 may include a plurality of unit duct holes 201*a*, 201*b* and 201*c*. The plurality of unit duct holes 201 may be configured to have different shapes. The plurality of unit duct holes 201*a*, 201*b* and 201*c* may be provided in the rear surface of the driver 200 so that the plurality of unit duct holes 201*a*, 201*b* and 201*c* may be covered by the damper film 221. The damper film 221 may be aligned with one of the plurality of unit duct holes 201.

For the user's convenience, the plurality of unit duct holes 201 may be sequentially arranged such that an airflow amount is increased or decreased in one direction.

The damper layer may be provided at a second rotating member 220*b*, and may be sequentially aligned with the plurality of unit duct holes 201 when rotated with the second rotating member 220*b*.

Like the first rotating member 220*a*, the second rotating member 220*b* may include the sealing member 223 and the rotating protrusion 222. Furthermore, the second rotating member 220*b* may be exposed to the outside.

According to the above embodiments, since a user can change not only the sound characteristics shown in FIGS. 17(*a*) and 17(*c*), but also the sound characteristic shown in FIG. 17(*b*) by means of the rotating member 220 of the driver 200, it is possible to perform tuning of sound characteristic across the entire audible frequency range.

In some cases, the earphone according to the present invention may also be configured to enable tuning only some of the above three sound characteristics. Although the above-described driver 200 is described as being able to change an airflow amount, the driver 200 may be configured to have a constant airflow amount in some cases.

Hereinafter, the effects of the earphone according to the present invention will be described.

According to at least one of the above embodiments of the present invention, there is an advantage of making it possible to easily remove foreign substances, which may accumulate on the nozzle cap or the nozzle mesh.

According to at least one of the above embodiments of the present invention, there is an advantage of being able to easily attach and detach the nozzle cap to and from the nozzle portion.

According to at least one of the above embodiments of the present invention, there is an advantage in that the shape of the sound hole in the nozzle portion is maintained without change regardless of coupling or detachment of the nozzle cap.

According to at least one of the above embodiments of the present invention, there is an advantage of being able to change sound characteristic by provision of the nozzle cap.

According to at least one of the above embodiments of the present invention, there is an advantage of being able to variably change sound characteristics by replacement between different kinds of nozzle caps.

According to at least one of the above embodiments of the present invention, there is an advantage of being able to realize sound characteristics of base, midrange and treble by replacement between different kinds of nozzle caps.

According to at least one of the above embodiments of the present invention, there is an advantage of being able to minimize a problem whereby unintended sound characteristics occur despite the use of replaceable nozzle caps.

According to at least one of the above embodiments of the present invention, there is an advantage of making it possible to independently control outputs in base, midrange and treble frequency ranges.

According to at least one of the above embodiments of the present invention, there is an advantage of making it possible to realize output characteristics which could not otherwise be realized using a conventional nozzle mesh.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. An earphone comprising:

a driver;

a housing providing an electrical component mount on which the driver is mounted, the housing including a nozzle portion provided at one end of the housing, the nozzle portion having a nozzle hole communicating with the electrical component mount, the nozzle portion having an outer circumferential surface;

a plurality of nozzle caps having an opening and interchangeably coupled to the outer circumferential surface of the nozzle portion, the plurality of nozzle caps including a first nozzle cap, a second nozzle cap and a third nozzle cap; and a nozzle mesh provided at the opening of each of the plurality of nozzle caps so as to cover the nozzle hole, wherein an outer boundary region of the nozzle mesh overlaps an inner surface of the nozzle cap and is interposed between the nozzle portion and the nozzle cap.

2. The earphone according to claim 1, wherein sound characteristics of bass are increased upon coupling of the first nozzle cap to the nozzle portion relative to coupling of either the second nozzle cap or the third nozzle cap to the nozzle portion, sound characteristics of midrange are increased upon coupling of the second nozzle cap to the nozzle portion relative to coupling either the first nozzle cap or the third nozzle cap to the nozzle portion, and sound characteristics of treble are increased upon coupling of the third nozzle cap to the nozzle portion relative to coupling either the first nozzle cap or the second nozzle cap to the nozzle portion.

3. The earphone according to claim 2, wherein assuming that, in a graph of output over frequency for the earphone, assuming that an output value corresponding to 1 kHz is designated as R, an area of an output value between 100 Hz to 1 kHz is designated as A and an area of an output value between 1 kHz to 10 kHz is designated as B, a value of B/(A+B) is less than 0.35 upon coupling of the first nozzle cap to the nozzle portion, the value of B/(A+B) is 0.35 to 0.65 upon coupling of the second nozzle cap to the nozzle portion and the value of B/(A+B) exceeds 0.65 upon coupling of the third nozzle cap to the nozzle portion.

4. The earphone according to claim 2, wherein, in a frequency range of 2 kHz to 6 kHz, there is a frequency range in which an output upon coupling of the first nozzle cap is increased by 3 dB or more than an output upon coupling of the second nozzle cap and a frequency range in which an output upon coupling of the third nozzle cap is decreased by 3 dB or more than the output upon coupling of the second nozzle cap.

5. An earphone comprising:

a driver;

a housing providing an electrical component mount on which the driver is mounted, the housing including a nozzle portion provided at one end of the housing, the nozzle portion having a nozzle hole communicating with the electrical component mount, the nozzle portion having an outer circumferential surface;

a nozzle cap having an opening and detachably coupled to the outer circumferential surface of the nozzle portion by one of the following:

(a) a hook unit provided on an outer circumferential surface of the nozzle portion and an inner circumferential surface of the nozzle cap, (b) a bent portion extending from the nozzle cap and bent toward an inner circumferential surface of the nozzle portion, the bent portion being engaged with a depressed portion formed in the outer circumferential surface of the nozzle portion, and (c) a screw engagement between the nozzle cap and the outer circumferential surface of the nozzle; and a nozzle mesh provided at the opening of the nozzle cap so as to cover the nozzle hole, wherein an outer boundary region of the nozzle mesh overlaps an inner surface of the nozzle cap and is interposed between the nozzle portion and the nozzle cap.

6. The earphone according to claim 5, wherein the nozzle cap is detachably coupled to the outer circumferential surface of the nozzle portion by the hook unit.

7. The earphone according to claim 6, wherein the hook unit comprises:

a protruding portion provided on one of the outer circumferential surface of the nozzle portion and the inner circumferential surface of the nozzle cap; and a depressed portion provided in a remaining one of the outer circumferential surface of the nozzle portion and the inner circumferential surface of the nozzle cap to receive the protruding portion.

8. The earphone according to claim 6, wherein an outer diameter of the nozzle cap is larger by a predetermined value than an outer diameter of a first region of the nozzle portion adjacent to the nozzle cap.

9. The earphone according to claim 8, wherein an outer diameter of a second region of the nozzle portion spaced apart from the nozzle cap is equal to the outer diameter of nozzle cap, the first region being located between the nozzle cap and the second region, and wherein the earphone further comprises an ear tip coupled to the nozzle cap to surround the outer circumferential surface of the nozzle cap and the second region of the nozzle portion.

10. The earphone according to claim 6, wherein the nozzle cap includes an ABS material, and is integrally formed with the nozzle mesh.

11. The earphone according to claim 6, wherein a diameter of the opening of the nozzle cap is equal to an inner diameter of the nozzle portion.

12. The earphone according to claim 6, further comprising an ear tip coupled to the nozzle cap at an upper surface of the nozzle so as to surround the nozzle cap and the nozzle.

13. The earphone according to claim 12, wherein the ear tip includes an opening, wherein the nozzle mesh is exposed to an outside of the earphone through the opening in the nozzle cap and the opening in the ear tip, and wherein a diameter of the opening in the nozzle cap is equal to a diameter of the opening in the ear tip.

14. The earphone according to claim 5, wherein the nozzle cap includes the bent portion and the nozzle portion includes the depressed portion.

15. The earphone according to claim 5, wherein the nozzle cap is coupled to the nozzle portion by screw engagement.

16. An earphone comprising:

a driver;

a housing providing an electrical component mount on which the driver is mounted, the housing including a nozzle portion provided at one end of the housing, the nozzle portion having a nozzle hole communicating with the electrical component mount, the nozzle portion having an outer circumferential surface;

a nozzle cap detachably coupled to the outer circumferential surface of the nozzle portion; and a nozzle mesh arrangement provided at the nozzle hole so as to cover the nozzle hole, the nozzle mesh arrangement including a first nozzle mesh and a second nozzle mesh overlapping the first nozzle mesh, wherein the first nozzle mesh is stacked on the second nozzle mesh, and the first nozzle mesh is provided in a portion of the second nozzle mesh and not in another portion of the second nozzle mesh.

17. The earphone according to claim 16, wherein the first nozzle mesh is provided at the nozzle cap, wherein the second nozzle mesh is provided in the nozzle hole in the nozzle portion, and wherein the nozzle cap is rotatably coupled to the outer circumferential surface of the nozzle portion such that an airflow amount into the earphone is adjustable by changing the orientation of the first nozzle mesh relative to the second nozzle mesh.

18. The earphone according to claim 17, wherein the second nozzle mesh defines a plurality of parallel linear holes, and the first nozzle mesh defines a plurality of parallel linear holes, the plurality of parallel linear holes in the first nozzle mesh being aligned with the plurality of parallel linear holes in the second nozzle mesh when the nozzle cap is rotated to a first angle and being oriented to be perpendicular to the plurality of parallel linear holes in the second nozzle mesh when the nozzle cap is rotated to a second angle.

* * * * *